US009687855B1

(12) United States Patent
Cox et al.

(10) Patent No.: US 9,687,855 B1
(45) Date of Patent: Jun. 27, 2017

(54) ROTARY GRINDER/SHREDDER

(71) Applicant: Republic Machine, Inc., Louisville, KY (US)

(72) Inventors: William W. Cox, Louisville, KY (US); George R. Sotsky, Louisville, KY (US)

(73) Assignee: Republic Machine, Inc., Louisville, KY (US)

( * ) Notice: Subject to any disclaimer, the term of this patent is extended or adjusted under 35 U.S.C. 154(b) by 386 days.

(21) Appl. No.: 14/291,492

(22) Filed: May 30, 2014

Related U.S. Application Data

(63) Continuation of application No. 13/111,468, filed on May 19, 2011, now Pat. No. 8,740,121, which is a continuation-in-part of application No. 12/488,166, filed on Jun. 19, 2009, now Pat. No. 7,959,099.

(51) Int. Cl.

| | |
|---|---|
| ***B02C 23/00*** | (2006.01) |
| ***B02C 18/14*** | (2006.01) |
| ***B02C 18/18*** | (2006.01) |
| ***B02C 23/16*** | (2006.01) |

(52) U.S. Cl.
CPC ..... *B02C 18/145* (2013.01); *B02C 18/18* (2013.01); *B02C 23/16* (2013.01); *B02C 2018/188* (2013.01); *B02C 2023/165* (2013.01)

(58) Field of Classification Search
CPC ... B02C 23/10; B02C 23/16; B02C 2023/165; B02C 18/145; B02C 18/18; B02C 2018/188
USPC ..... 241/73, 74, 79, 242, 243, 249
See application file for complete search history.

(56) References Cited

U.S. PATENT DOCUMENTS

| | | | | |
|---|---|---|---|---|
| 1,185,620 | A * | 6/1916 | Blum | B02C 13/16 209/405 |
| 2,315,028 | A * | 3/1943 | Thomas | A23N 1/003 100/121 |
| 2,660,242 | A | 11/1953 | Lane | |
| 3,001,728 | A * | 9/1961 | Kircher, Jr. | B02C 18/148 241/185.5 |
| 3,381,904 | A * | 5/1968 | Glidden | B02C 13/14 241/294 |
| 3,662,444 | A | 5/1972 | Erkfritz | |
| 3,694,876 | A | 10/1972 | Erkfritz | |
| 3,716,900 | A | 2/1973 | Erkfritz | |
| 4,009,836 | A * | 3/1977 | Strom et al. | B02C 13/04 241/189.2 |

(Continued)

FOREIGN PATENT DOCUMENTS

DE 4005647 A1 8/1990

*Primary Examiner* — Faye Francis
(74) *Attorney, Agent, or Firm* — Middleton Reutlinger; James E. Cole

(57) ABSTRACT

A screen and rotor assembly is provided having a rotor of cylindrical shape having a plurality of toolholders in a preselected spaced pattern about an outer surface of the rotor, cutting tools connected to the plurality of toolholders and a screen positioned adjacent the rotor in close tolerance to the cutting tools. The screen has a plurality of transverse extending screen segments defining a plurality of apertures therebetween wherein the apertures form rows in a circumferential direction about the rotor. The cutting tools are centered relative to one or more of the apertures in an axial direction of the rotor. A path of the cutting tools aligned with respect to a row of the apertures extending in a circumferential direction.

24 Claims, 33 Drawing Sheets

(56) References Cited

U.S. PATENT DOCUMENTS 4,015,783 A * 4/1977 Miller ..... B02C 13/284 241/285.1
4,247,232 A 1/1981 McCreery et al.
4,385,732 A * 5/1983 Williams ..... B02C 18/0084 241/236
4,507,024 A 3/1985 Stashko
4,545,539 A * 10/1985 Steffensen ..... B02C 18/148 241/160
4,785,860 A 11/1988 Arasmith
4,830,291 A * 5/1989 Williams ..... B02C 13/282 241/186.3
5,044,570 A 9/1991 Montgomery, Sr.
5,100,070 A 3/1992 Montgomery, Sr.
5,150,844 A * 9/1992 McKie ..... B02C 13/06 241/191
5,192,171 A 3/1993 Ther et al.
5,199,827 A 4/1993 Pantzar
5,207,748 A 5/1993 Katbi et al.
D340,464 S 10/1993 Markusson et al.
5,381,972 A * 1/1995 Chon ..... B02C 13/288 241/189.1
D367,866 S 3/1996 Pantzar et al.
D369,362 S 4/1996 Pantzar et al.
5,544,984 A 8/1996 Pantzar
5,653,274 A 8/1997 Johnson et al.
5,799,884 A * 9/1998 Alavi ..... B02C 18/142 241/243
D409,633 S 5/1999 Bernadic et al.
5,913,484 A * 6/1999 Kurtz ..... B26D 3/22 241/100
5,950,940 A * 9/1999 Hoof ..... B02C 13/284 241/189.1
6,035,844 A 3/2000 Otani et al.
6,158,928 A 12/2000 Hecht
6,176,445 B1 1/2001 Shinn
6,234,724 B1 5/2001 Satran et al.
6,260,778 B1 * 7/2001 Wenger ..... B02C 18/067 241/101.761
6,305,623 B1 10/2001 Sotsky et al.
6,422,495 B1 7/2002 De Boef et al.
6,523,768 B2 2/2003 Recker et al.
6,640,853 B1 11/2003 Sun
6,698,477 B1 3/2004 Bennington
6,729,566 B2 * 5/2004 Giesedieck ..... B02C 13/30 241/194
6,736,342 B2 * 5/2004 van Loo ..... B02C 18/142 241/243
6,742,970 B2 6/2004 Oles et al.
6,827,304 B2 * 12/2004 Rousseau ..... A01K 5/002 241/243
6,837,453 B2 1/2005 Sturm
6,848,640 B2 2/2005 Pallmann
6,880,774 B2 4/2005 Bardos et al.
6,983,904 B2 1/2006 Plahuta et al.
7,055,770 B2 6/2006 Bardos
7,100,855 B2 9/2006 Diemunsch
7,213,778 B2 * 5/2007 Astafan ..... B02C 18/141 241/197
7,213,779 B2 5/2007 Roozeboom et al.
D555,684 S 11/2007 Waggle et al.
7,293,729 B2 11/2007 Ragnarsson
7,390,151 B2 6/2008 Martin et al.
7,832,667 B2 * 11/2010 Doppstadt ..... B02C 18/2216 241/243
7,959,099 B1 6/2011 Cox et al.
D655,731 S 3/2012 Cox et al.
D666,640 S 9/2012 Cox et al.
D676,071 S 2/2013 Cox et al.
D676,072 S 2/2013 Cox et al.
8,544,776 B2 * 10/2013 Pallmann ..... B02C 18/141 241/243
8,740,121 B1 6/2014 Cox et al.
2003/0061926 A1 4/2003 Sotsky
2006/0102762 A1 5/2006 Garcia et al.
2009/0008491 A1 1/2009 Sharp
2009/0121058 A1 * 5/2009 Doppstadt ..... B02C 18/145 241/88.2
2013/0240652 A1 * 9/2013 Gardner ..... B07B 1/185 241/89.1

* cited by examiner

ROTARY GRINDER/SHREDDER

CROSS-REFERENCE TO RELATED DOCUMENTS

This continuation patent application claims priority and benefit under 35 U.S.C. §120 to currently pending U.S. patent application Ser. No. 13/111,468, filed on May 19, 2011, which is a continuation-in-part of and claims priority and benefit under 35 U.S.C. §120 to U.S. application Ser. No. 12/488,166 filed on Jun. 19, 2009, now U.S. Pat. No. 7,959,099, all of which is incorporated by reference herein.

TECHNICAL FIELD

This invention pertains to a shredder rotor assembly. More specifically, the invention pertains to a shredder rotor assembly having bolt-in toolholder assemblies connecting the cutting tools to the toolholders and the toolholders to the rotor.

BACKGROUND

Various types of shredding devices are known in the art. Rotor devices often utilize welded toolholders and bolted cutting tools as part of the rotor assemblies. However, welded toolholders are prone to breaking from the rotor after periods of use. The welded toolholders are difficult to replace without removal of the rotor from the shredding implement.

Given the forgoing problems with the current art of rotor devices, toolholders are desirable which are durable, easily replaceable and may be retrofit to existing rotor systems.

SUMMARY

A bolt-in toolholder assembly for a shredding device, comprises a rotor having a substantially cylindrical shape, a plurality of pockets formed in the rotor and spaced apart preselected distances to form preselected patterns, a toolholder shaped to fit and be seated within the at least one of the plurality of pockets, the toolholder comprising a base portion and a cutter mounting surface, the base having a first fastening aperture and receiving a first bolt for bolting the toolholder to the rotor, the cutter mounting surface having a second fastening aperture and receiving a second bolt for bolting the toolholder to the rotor, the first and second fastening apertures being circumferentially aligned, a third fastening aperture extending substantially transverse to the second fastening aperture and receiving a third bolt across the second fastening aperture and through the cutter mounting surface and, a cutting tool disposed against the cutter mounting surface where the cutter mounting surface extends upwardly from the base, the third bolt connecting the cutting tool to the cutter mounting surface. The bolt-in toolholder assembly further comprising one of a radius and a chamfer between the base and the cutter mounting surface. The bolt-in toolholder assembly further comprising an insert between the cutter mounting surface and the cutting tool. The bolt-in toolholder assembly wherein the insert has one of a radiused or chamfered edge substantially corresponding to the radius or chamfer between the base and the cutter mounting surface. The bolt-in toolholder assembly wherein the third bolt extends from the rear of the toolholder through the cutter mounting surface. The bolt-in toolholder assembly further comprising a machined portion in a rear surface of the toolholder for receiving a bolt head. The bolt-in toolholder assembly wherein the rotor has a substantially flat surface. The bolt-in toolholder assembly wherein the cutting tool is trapezoidal in shape. The bolt-in toolholder assembly wherein the cutting tool is substantially square in shape. The bolt-in toolholder assembly wherein the rotor has a substantially corrugated surface. The bolt-in toolholder assembly wherein the cutting tool is substantially square and has a corner extending into the corrugated surface. The bolt-in toolholder assembly further comprising at least one cap for covering at least one of the fastening apertures. The bolt-in toolholder assembly wherein the preselected pattern is chevron shaped. The bolt-in toolholder assembly wherein the preselected pattern being spiral shaped.

A bolt-in toolholder assembly for a shredding device comprises a rotor having a substantially cylindrical shape, a plurality of toolholders bolted to the rotor in a preselected pattern and spacing, a plurality of pockets disposed along the rotor, the plurality of toolholders disposed in the plurality of pockets, each of the plurality toolholders having a base and a tool mounting portion, each of the plurality of toolholders having a first bolt extending through the base and a second bolt extending through the tool mounting portion, first and second bolt holes receiving bolts generally extending radially into the rotor, a third bolt hole extending through the tool mounting portion and intersecting the second bolt hole, a cutting tool positioned on the tool mounting portion, the cutting tool having an aperture aligned with the third bolt hole and, a third bolt extending through the tool mounting portion and engaging the cutting tool. The bolt-in toolholder assembly wherein the preselected pattern is one of spiral or chevron shaped. The bolt-in toolholder assembly further comprises an insert disposed between the cutting tool and the tool mounting portion of the toolholder. The bolt-in toolholder assembly wherein the first and second bolts are aligned circumferentially to narrow a width of each of the plurality of toolholders. The bolt-in toolholder assembly wherein the width of each of the plurality of toolholders is less than a width of the cutting tool. The bolt-in toolholder assembly wherein the rotor is one of a substantially smooth surface and a corrugated surface. The bolt-in toolholder assembly wherein the cutting tool has one of a smooth surface corresponding to said smooth surface of said rotor and a corner extending into said corrugated surface. The bolt-in toolholder assembly wherein the third bolt extends in a direction of rotor rotation. The bolt-in toolholder assembly further comprising caps for the first and second bolt holes.

A bolt-in toolholder assembly for shredding comprises a rotor having a generally cylindrical shape, a plurality of pockets disposed along a periphery of the rotor in a preselected pattern, at least one of the pockets having a toolholder including a base disposed within the pocket and a cutting tool portion extending above an upper surface of the rotor, a first bolt hole extending through the base and aligned with a fastener aperture in the rotor, a second bolt hold extending through the cutting tool portion and circumferentially aligned with a second fastener aperture in the rotor, a third bolt passing through the third bolt hole and engaging the cutting tool and, a cutting tool fastened to the toolholder. The bolt-in toolholder wherein at least one of the plurality of pockets has a cap covering the pocket.

A cutting tool for a bolt-in toolholder assembly in a shredding device including a rotor and a bolt-in toolholder, comprises an upper surface and a lower surface, a first side and a second side extending between ends of the upper and lower surfaces, the upper, lower and first and second side surfaces defining a polygon shaped cutting tool, the cutting tool having a forward side and a rearward side, a cutting surface having by an upper portion and opposed side portions, the cutting surface disposed on at least one of the forward side and the rearward side, the cutting surface being offset from a well, the well having a flat inner surface for seating the cutting tool in a first dimension, the well being polygonal in shape, the well size determining a width of the cutting surface, a bolt-in aperture disposed in the well. The cutting tool wherein the lower surface has a first foot and a second foot, the second foot spaced from the first foot. The cutting tool wherein a notch is defined between the first foot and the second foot. The cutting tool wherein the notch provides a second seat in a second dimension. The cutting tool wherein the lower surface has a key for engaging a toolholder. The cutting tool wherein said key is a polygon shape. The cutting tool wherein the key is rectangular. The cutting tool wherein the key is circular. The cutting tool further comprises a second cutting surface disposed on the other of said forward side and said rearward side. The cutting tool further comprising a second well disposed within the second cutting surface. The cutting tool wherein the cutting tool is symmetrical about a vertical axis. The cutting tool wherein the first cutting surface and the second cutting surface allow cutting along the forward side or the rearward side of the cutting tool.

A cutting tool for a bolt-in toolholder assembly, comprises a first cutting surface defining an outer perimeter of a forward side of the cutting tool, a second cutting surface defining an outer perimeter of a rearward side of the cutting tool, the rearward side being opposite the forward side, a first well and a second well each disposed within the first and second cutting surfaces respectively, the first and second wells each having a flat surface substantially parallel to and offset from the respective first and second cutting surfaces, an upper surface, a lower surface and first and second side surfaces extending between the first and second cutting surfaces, the first and second cutting surfaces being polygon shaped. The cutting tool wherein the first and second wells are substantially polygon shaped. The cutting tool wherein the polygon shaped wells and the polygon shaped cutting surfaces are trapezoidal shaped. The cutting tool wherein the polygon shaped wells and the polygon shaped cutting surfaces are square shaped. The cutting tool wherein corners of the wells are rounded. The cutting tool further comprising a bolt aperture passing through at least one of the first and second wells. The cutting tool further comprising an insert disposed within one of the first well and the second well. The cutting tool wherein the insert is disposed between the cutting tool and a toolholder. The cutting tool wherein the insert fits within one of the first and second wells and is disposed against the toolholder. The cutting tool further comprising a counterknife. The cutting tool wherein the cutting tool interstitially passes through the counterknife. The cutting tool wherein a lower end of the cutting tool enters counterknife before the upper end. The cutting tool wherein a key is positioned on the lower surface of the cutting tool. The cutting tool wherein the key is one of circular or polygon shaped.

A cutting tool for use with a shredding machine, comprises a forward side and a rearward side opposite said forward side, each of the forward side and the rearward side having a cutting surface defined by at least an upper edge, a first side and a second side, a well disposed within a boundary of the cutting surface on each of the forward and rearward sides, each of the wells having a lower well surface substantially parallel to and offset from the cutting surface and further comprising a fastening aperture passing from the well of the first side to the well of said second side, the cutting tool being substantially trapezoidal in shape and being reversible about a vertical axis to cut along the forward side and the rearward side along the cutting surface. The cutting tool wherein the cutting surfaces may be re-surfaced for re-use of the tool. The cutting tool wherein the well provides a substantially unaffected surface for seating of an insert between the cutting tool and a toolholder. The cutting tool further comprising an offset surface extending from the cutting surface to the inner well surface.

A screen and rotor assembly for a rotary grinding machine, comprises a rotor having a cylindrical shape, a plurality of toolholders disposed along the rotor, the rotor rotatable about a horizontal axis, a screen disposed adjacent the rotor, the screen having a plurality of apertures of preselected spacing, a plurality of cutting tools connected to the plurality of toolholders, each of the cutting tools substantially centered with one or more of the apertures of the screen in a direction of the horizontal axis, the screen having a substantially even surface in a circumferential and axial direction for reducing clearance between the cutting tools and the screen. The screen and rotor assembly wherein the screen having a plurality of screen segments defining the apertures. The screen and rotor assembly wherein the screen segments extend circumferentially and are aligned with spaces between adjacent cutting tools. The screen and rotor assembly wherein the plurality of apertures are aligned in an axial direction. The screen and rotor assembly wherein the plurality of apertures are aligned in a circumferential direction. The screen and rotor assembly wherein the plurality of apertures define a number of rows in both a circumferential direction and an axial direction. The screen and rotor assembly wherein rotation of the rotor creates a circular path of travel for each of the cutting tools. The screen and rotor assembly wherein the circular path of travel of each of the cutting tools is aligned with a row of the screen apertures in a circumferential direction. The screen and rotor assembly wherein the toolholders are bolt-in toolholders. The screen and rotor assembly wherein the apertures are rectangular. The screen and rotor assembly wherein the apertures are generally u-shaped with a closed end. The screen and rotor assembly wherein the apertures are diamond shaped. The screen and rotor assembly wherein the apertures are triangular in shape.

A screen and rotor assembly comprises a rotor of cylindrical shape having a plurality of toolholders in a preselected spaced pattern about an outer surface of the rotor, cutting tools connected to the plurality of toolholders, a screen positioned adjacent the rotor in close tolerance to the cutting tools, the screen having a plurality of transverse extending screen segments defining a plurality of apertures therebetween, the apertures forming rows in a circumferential direction about the rotor, the cutting tools centered relative to one or more of the apertures in an axial direction of the rotor, wherein a path of the cutting tools aligned with respect to a row of the apertures extending in a circumferential direction. The screen and rotor assembly wherein the circumferentially extending screen segments are disposed between the cutting tools of the rotor. The screen and rotor assembly wherein the screen is a unitary assembly connectable to a rotary grinder. The screen and rotor assembly wherein the screen is removably connectable to the rotary grinder. The screen and rotor assembly further comprising a counterknife disposed adjacent to the rotor wherein the cutting tools interstitially pass through the counterknife during rotation of the rotor. The screen and rotor assembly wherein a cutting surface of the cutting tools has a non-parallel relationship with the upper surface of the counterknife as the cutting tools enter the counterknife. The screen and rotor assembly wherein lower ends of the cutting tools enter the counterknife before the upper ends. The screen and rotor assembly wherein upper ends of the cutting tools enter the counterknife before the lower ends. The screen and rotor assembly wherein a cutting surface of the cutting tools has a parallel relationship with the upper surface of the counterknife as the cutting tools enter the counterknife.

A screen and rotor assembly, comprises a cylindrical rotor having a plurality of tool holders, a plurality of cutting tools connected to the plurality of tool holders, a classification screen positioned adjacent a portion of the travel path of the plurality of cutting tools, the screen having an inner surface of constant elevation, the screen having a plurality of screen segments defining a plurality of apertures, the plurality of apertures arranged in circumferentially extending rows wherein: each of the plurality of cutting tools is aligned in an axial direction with at least one of the plurality of apertures and, a path of travel of each of the cutting tools is aligned with one or more axially aligned apertures and adjacent said plurality of apertures of said screen. The screen and rotor assembly wherein the apertures are one of rectangular, triangular, diamond shaped, or substantially u-shaped.

BRIEF DESCRIPTION OF THE ILLUSTRATIONS

Embodiments of the invention are illustrated in the following illustrations.

Figure 31:
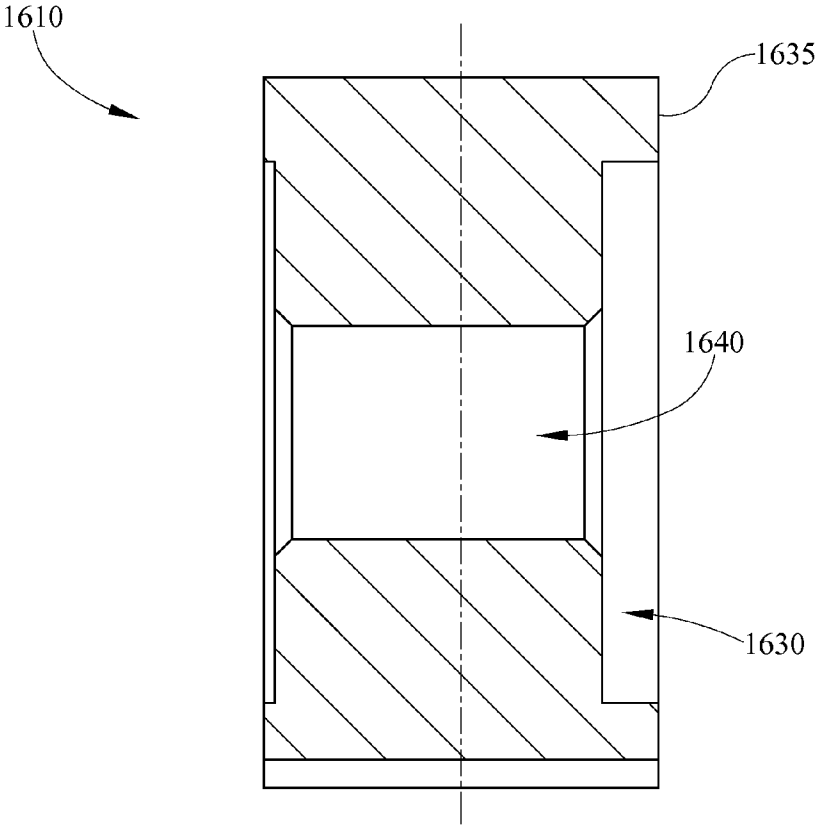
Figure 34:
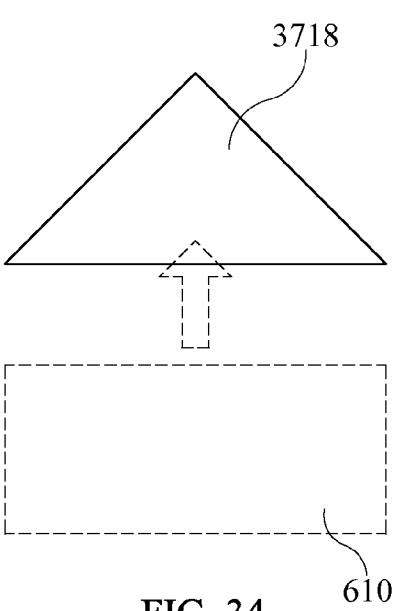
Figure 33:
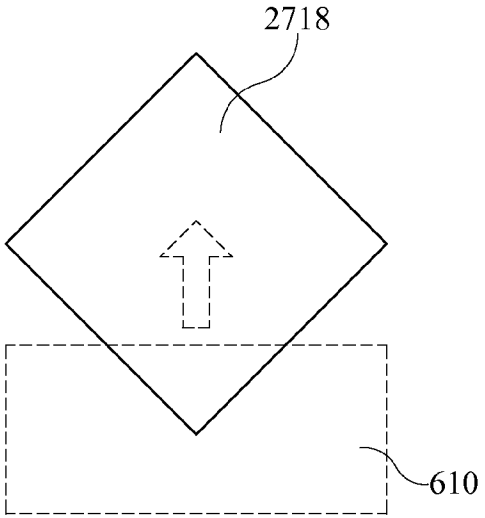
Figure 32:
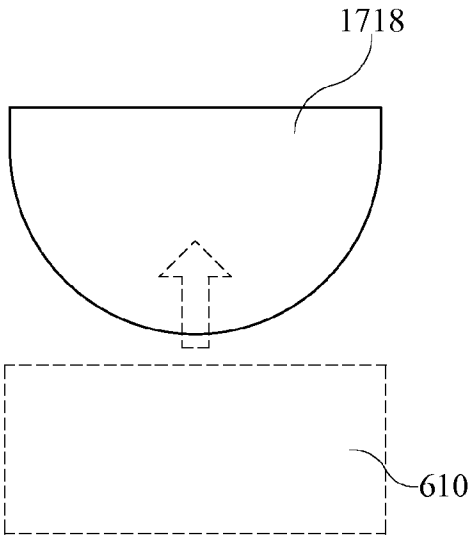
Figure 35:
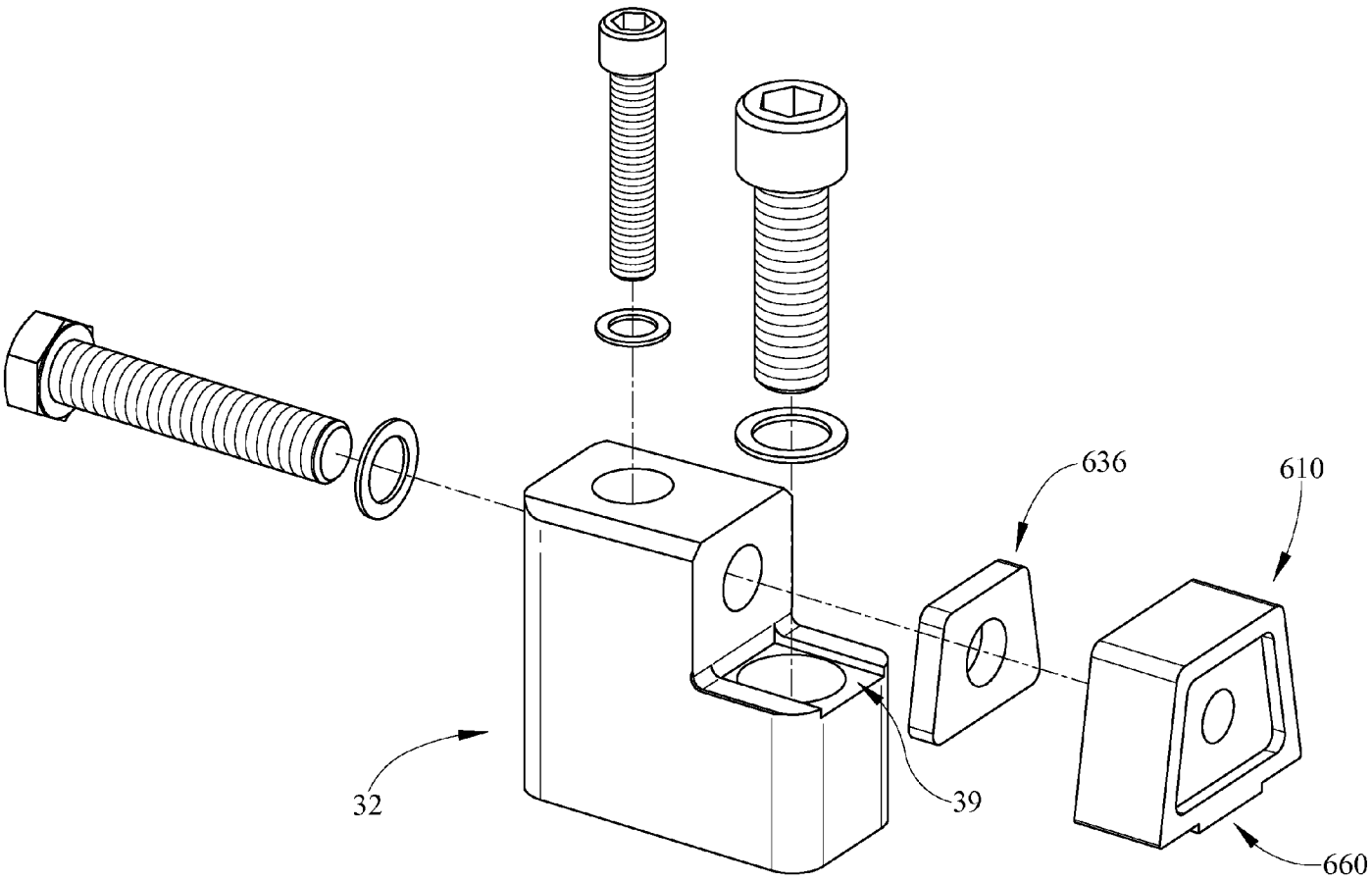

FIG. 31 a side section view of an alternative cutting tool which has a single cutting surface on a single side of the tool;

FIG. 32 is a first alternative embodiment of a screen aperture;

FIG. 33 is a second alternative embodiment of a screen aperture;

FIG. 34 is a third alternative embodiment of a screen aperture; and,

FIG. 35 is an exploded perspective view of an alternative cutting tool and toolholder.

DETAILED DESCRIPTION

Figure 1:
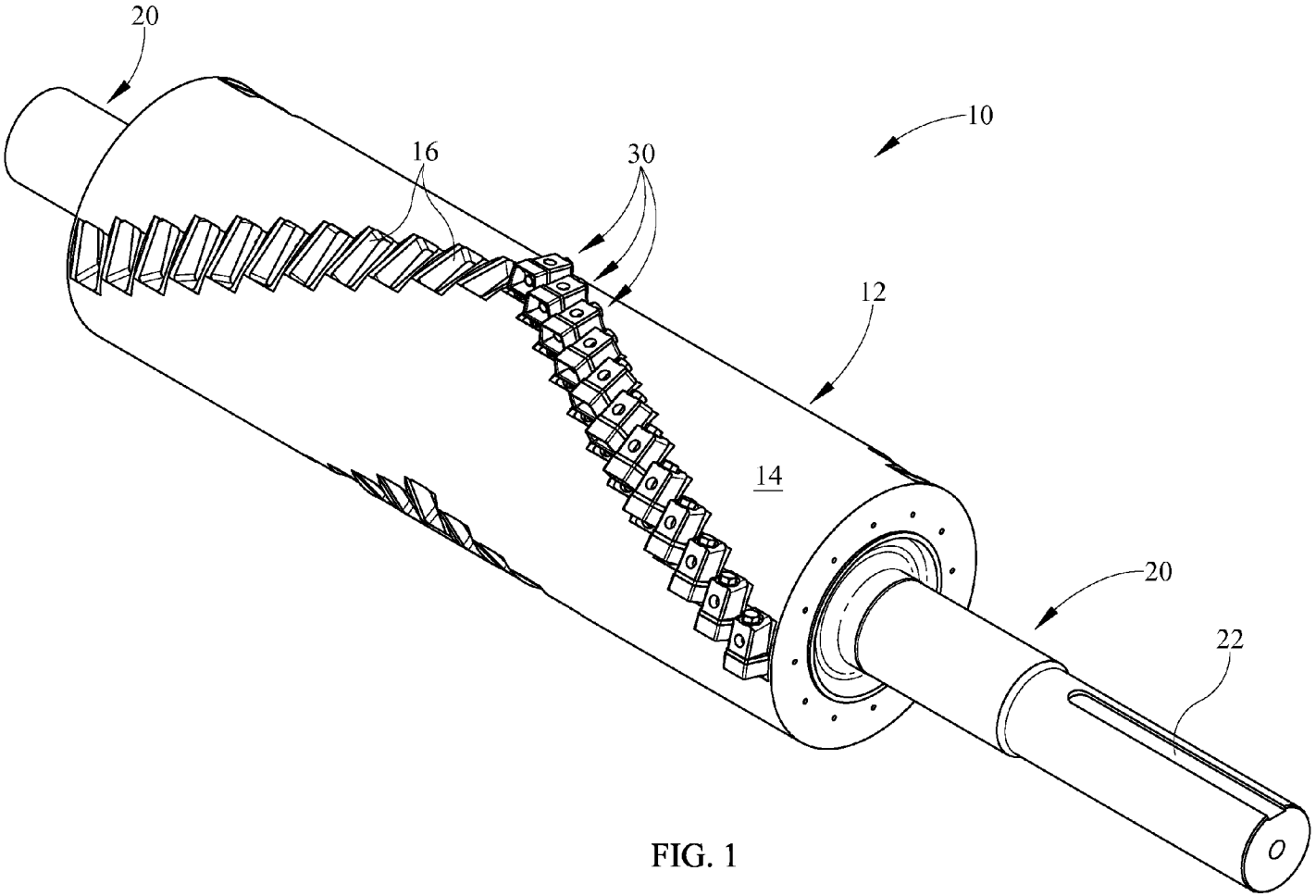
FIG. 1 depicts a perspective view of a rotor assembly having bolt-in toolholders.

Referring initially to FIG. 1, a shredder rotor assembly 10 is depicted in perspective view. The rotor assembly 10 comprises a rotor 12 having a substantially cylindrical shape and a substantially smooth outer surface 14 although the smooth surface is exemplary as will be understood upon further view of this disclosure. Positioned along the surface 14 are a plurality of pockets 16 which have a preselected shape. The pockets 16 are narrowly spaced together to allow for a closer spacing of cutting tools 34 (FIG. 4), as described further herein. The pockets 16 are also shown offset from one another circumferentially some preselected angular distance. The pockets 16 are offset, or indexed, an arcuate distance less than the arcuate length of pockets 16. However, the amount of index may vary as the instant embodiment is merely exemplary. For example, the index distance will differ for a chevron pocket arrangement and a spiral pocket arrangement. The pockets 16 are arranged in such a manner so that the cutting tools 34 do not all pass through the counter knife (not shown) as the same time which would induce an extremely large loading on the cutting tools 34, toolholders 32 and rotor 12, as well as the transmission and motor driving the shredder rotor assembly 10. According to the exemplary embodiment of FIG. 1, the pockets 16 are generally arranged in shape of a chevron, however, such arrangement is merely exemplary and alternative shapes and arrangements may be utilized and therefore are well within the scope of the present arrangements. The exemplary shape permits two cutting tools 34 to pass through the counter knife at a given instant. Extending from the rotor 12 at axial ends is a shaft 20. The shaft 20 may be integrally formed with the rotor 12, for example by machining, or may be fastened or welded to the rotor 12. The shaft 20 extends from first and second ends of the rotor 12. The shaft 20 additionally comprises a key way 22 located at one of the first end and the second end of the shaft 20. The key way 22 allows for torque transmission from a motor or a transmission (not shown) to a shaft 20 in order to rotate the rotor assembly 10, as will be understood by one skilled in the art.

Disposed within the pockets 16 are toolholder assemblies 30. According to the instant embodiment, the toolholder assemblies 30 are closely spaced to provide additional shredding capability and cut material into smaller particles. The toolholder assemblies 30 are each positioned in the pocket 16 and therefore, according to the exemplary embodiment, are closely spaced in the axial direction and circumferentially offset by a preselected angular distance, as previously described with respect to the pockets 16.

Figure 2:
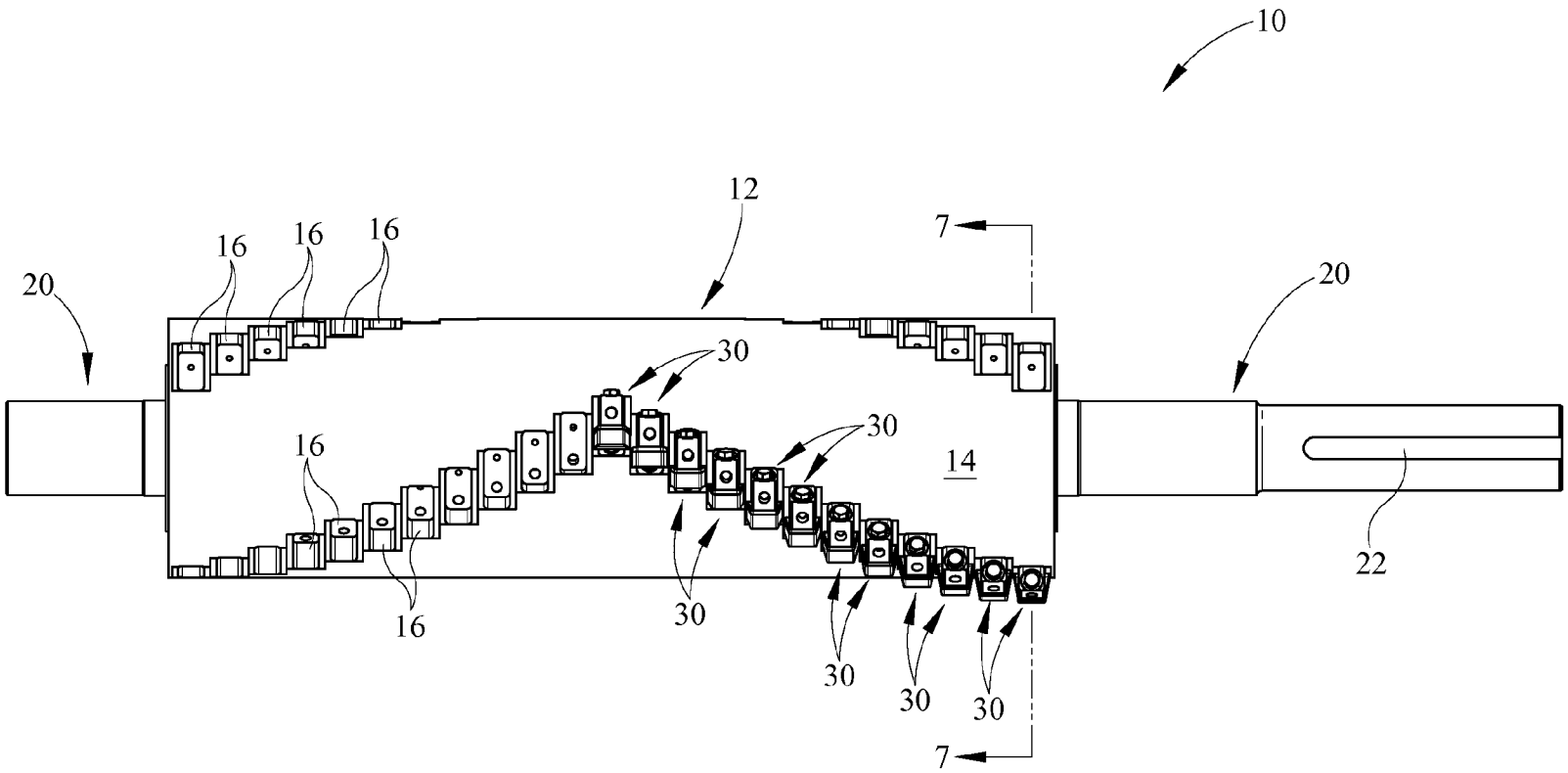
FIG. 2 depicts a front view of the rotor assembly of FIG. 1.

Referring to FIG. 2, the rotor assembly 10 is shown in a front view. The rotor assembly 10 is depicted rotated about the axis of the shaft 20 about ninety (90) degrees from the view of FIG. 1. The pockets 16 are shown both occupied and unoccupied by various toolholder assemblies 30 merely for illustration. The positioning of pockets 16 along the upper area of rotor surface 14 clearly show the circumferential offset or indexing which provides improved cutting or tearing capacity without requiring axial alignment of the toolholder assemblies 30.

The view of the toolholder assemblies 30 disposed on the rotor 12 shows the close spacing of the cutting tools 34 so that material being shredded may be cut into smaller particles. The narrow spacing of the toolholder assemblies 30 is possible due to the narrow shape of the toolholders 32. Thus, there is little to no space, in the instant embodiment, between adjacent cutting tools 34 and this is possible due to the narrow configuration of the toolholders 32.

Figure 3:
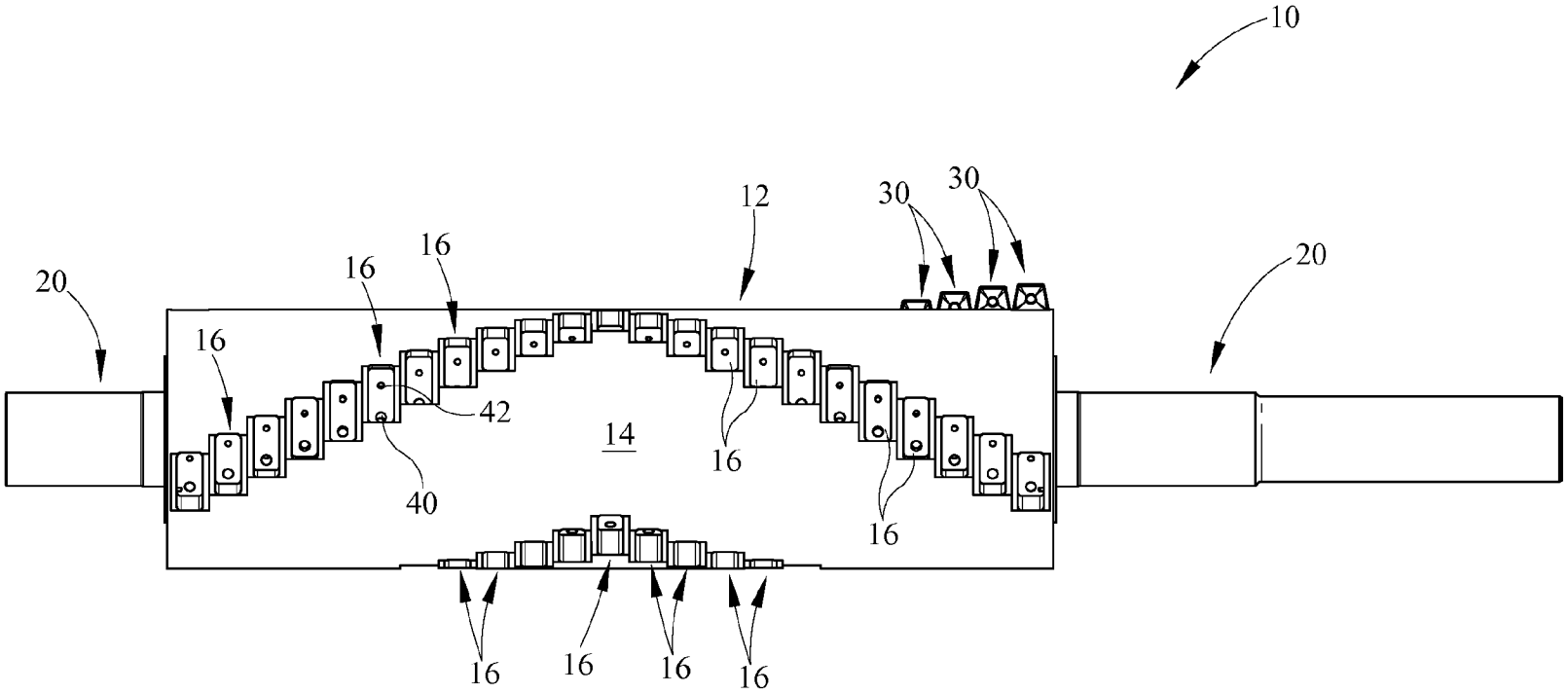
FIG. 3 depicts a front view of the rotor assembly of FIG. 1, rotated from the position shown in FIG. 2.

Referring to FIG. 3, the rotor 12 is rotated some arcuate distance from the position shown in FIG. 2. The assemblies 30 are removed from pockets 16 allowing viewing of the internal surfaces of each pocket 16. Each pocket 16 comprises a first fastening aperture 40 and a second fastening aperture 42. The first fastening aperture 40 is larger in diameter than the second fastening aperture 42. The first fastening aperture 40 is larger and receives a larger fastener in order to inhibit torque induced movement of the toolholder assembly 30 when the cutting tool 34 is acted upon by a force due to the shredding or cutting.

Figure 4:
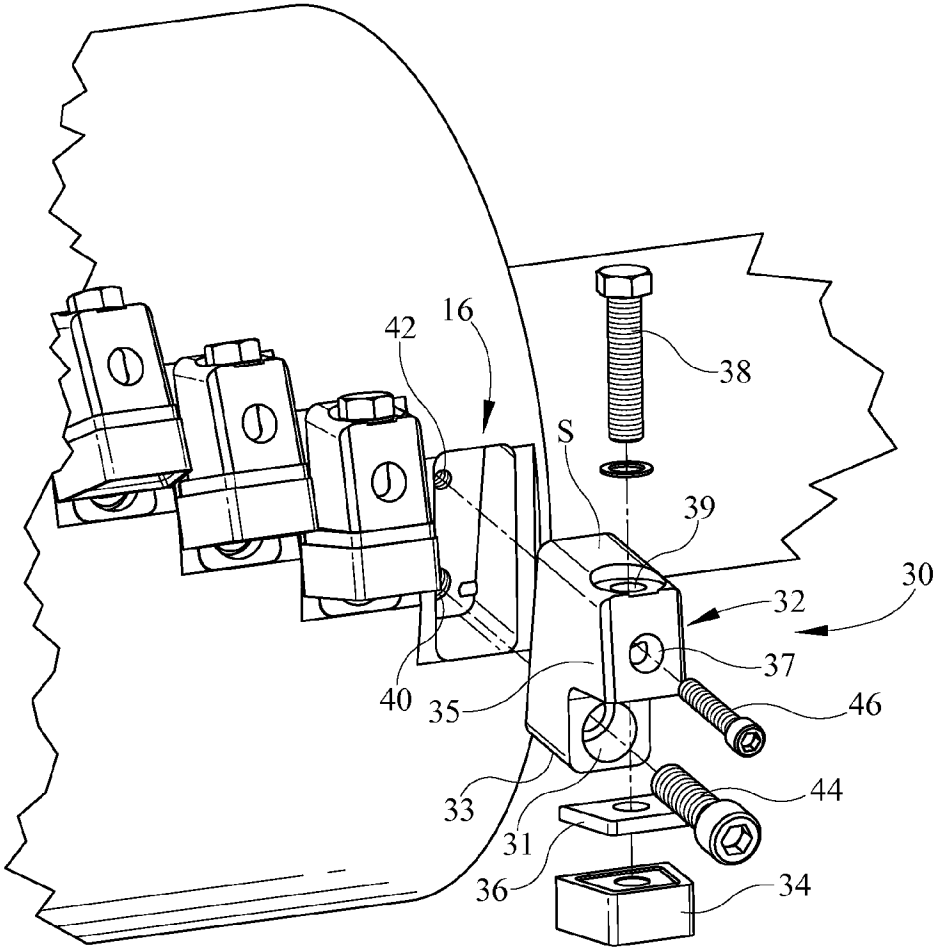
FIG. 4 depicts an exploded perspective view of the bolt-in toolholder.
Figure 5:
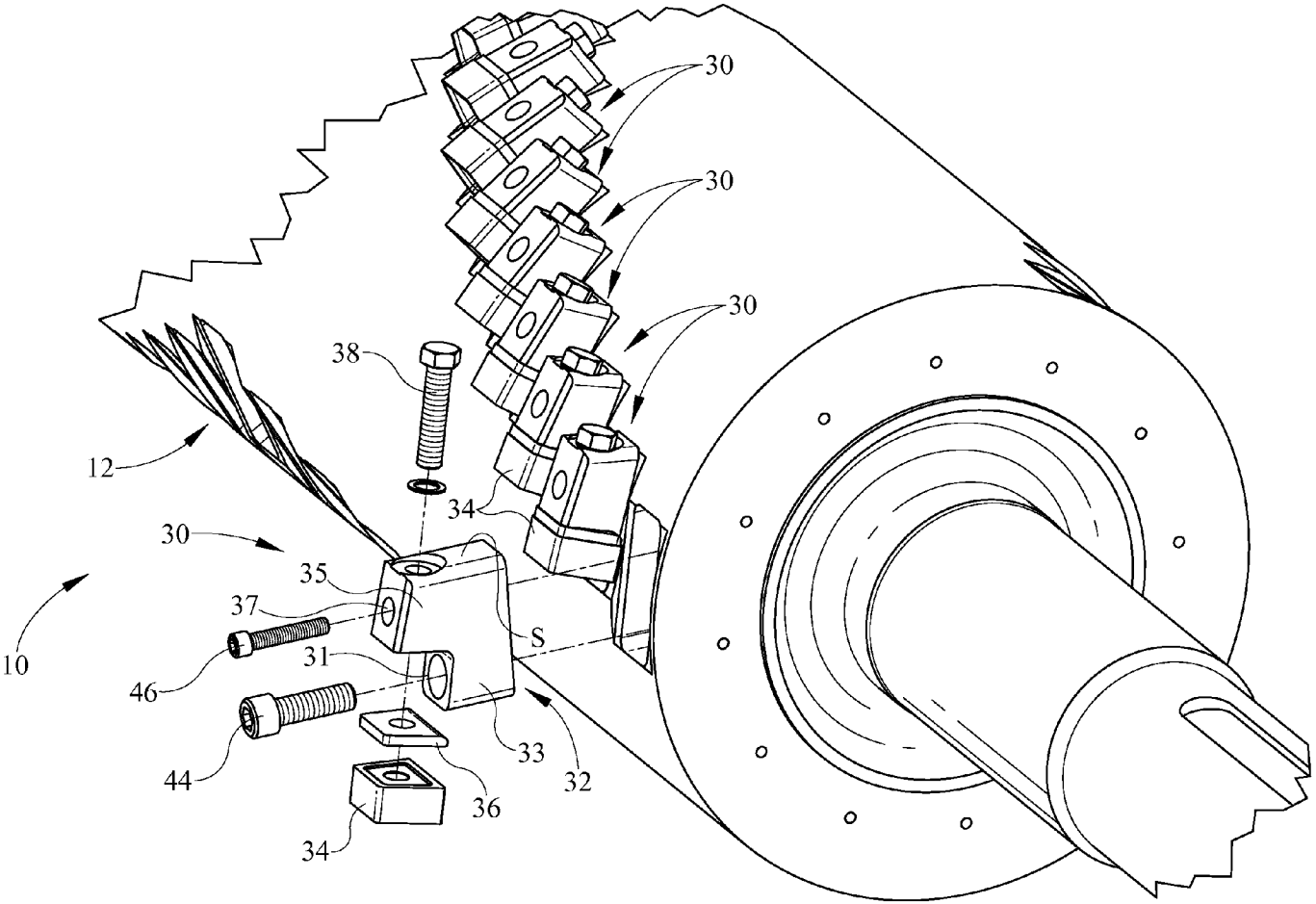
FIG. 5 depicts an alternative exploded perspective view of the bolt-in toolholder.

Referring now to FIGS. 4 and 5 exploded perspective views of the rotor assembly 10 and toolholder assemblies 30 are depicted. Specifically, FIGS. 4 and 5 each show one exploded toolholder assembly 30 removed from a pocket 16. Within the pocket 16, the first fastening aperture 40 and the second fastening aperture 42 are depicted in the lower most surface of the pocket. Exploded from the pocket 16, each toolholder assembly 30 comprises a toolholder 32, a cutting tool 34 and an insert 36. The assembly 30 further comprises a first fastener 44 and a second fastener 46. The first and second fasteners 44 and 46 are both depicted by bolts which extend through the toolholder 32 and into the rotor 12 creating a substantially radial tightening force. The first and second fasteners 44, 46 are both aligned in the circumferential direction about the rotor 12. Finally, the assembly 30 further comprises a third bolt 38 extending through the toolholder 32. The toolholder 32 comprises a base 33 and a cutter mounting portion 35 extending upwardly through the base 33. Extending downwardly through the base 33 is a first fastening aperture 31 which receives first bolt 44 and is axially aligned with the first fastening aperture 40 in the pocket 16. The first bolt or fastener 44 extends substantially radially toward the center axis of the rotor assembly 10 through the toolholder 32 and into the rotor 12.

Circumferentially aligned with the first fastening aperture 31 is a second fastening aperture 37. Second fastening aperture extends through the upper surface of the cutter mounting portion 35. This aperture 37 is aligned with the second fastening aperture 42 in the pocket 16, both of which receive the second fastener or bolt 46 there through. The circumferential alignment of the first and second bolts 44, 46 and first and second aperture 31, 37 of the toolholder 32 allows for a narrow base of the toolholder 32. This in turn allows for more cutting tools 34 to be positioned across a given axial length of rotor 12. Having a narrow toolholder 32 provides that the toolholder 32 has a width less than the width of the cutting tool 34. This also allows for minimal spacing between immediately adjacent cutting tools 34. As previously described, these additional cutting tools 34 allow for smaller pieces of material to be cut or shred by the rotor assembly 10.

The rear surface S of the toolholder 32 is a bearing surface and force acts though the cutting tool 34. The bearing surface passes this force to the rotor 12 through the adjacent rear pocket surface. As the toolholder 32 is forced against the rear surface of the pocket 16, the first bolt 44 counteracts the moment which is created. For this reason, the first fastener 44 is of a larger diameter than second fastener 46.

The toolholder 32 further comprises a third fastening aperture 39 extending through the cutter mounting portion 35 and intersecting the axis defined by the second aperture 37. The third bolt aperture 39 intersects the axis defined by the second aperture 33. When the third bolt 38 is inserted through the cutter mounting portion 35 the second bolt 46 must have already been positioned on the second aperture 33 and be fastened into the rotor 12. The rear surface of the toolholder 32 may have a radiused area for receiving the head of third bolt 38. Since the axis of the third aperture 39 intersects that of the second aperture 37, the second bolt 46 must be positioned through the toolholder 32 prior to insertion of the third bolt 38 because upon insertion of the third bolt 38, the second aperture 37 would be blocked from passage of the upper surface of the toolholder base 33.

Referring still to FIG. 5, the circumferential offset of the toolholder assemblies 30 are depicted. The arcuate distance offset between adjacent toolholder assemblies 30 are about eight (8) degrees as measured from the cutting edge of one cutting tool 34 to an adjacent tool 34 on an adjacent toolholder assembly 30. However, this number should not be considered limiting as various arcuate offset angles, and therefore distances, may be utilized. According to this embodiment, the arcuate distance of the offset is less than the arcuate length of an assembly 30.

Exploded from the toolholder 32 is an insert 36. The insert 36 may be formed of a polymeric or elastomeric material which cushioned the cutting tool 34 against the cutter mounting portion 35. According to the exemplary embodiment, insert 36 may alternatively be formed of metal or other hardened material which still has a cushioning effect between the cutting tool 34 and the toolholder 34. The material used for the insert 36 may be formed of a metal which is softer than the tool 34 and the toolholder 32 in order to aid cushioning. The lower edge of the insert 36 is radiused or chamfered to match a corresponding radius or chamfer between upwardly facing the surface of the base 33 having the first fastening aperture 31 and the upwardly extending surface of the cutter mounting portion 35. The radius or chamfer is disposed between the two adjacent surfaces in order to strengthen the toolholder 32. The insert 36, therefore, clears the radiused area of the toolholder 32 providing a better fit for the cutting tool 34, eliminating the need to chamfer or radius the cutting tool 34 as well as providing the aforementioned cushioning between the cutting tool 34 and the cutter mounting portion 35.

Figure 6:
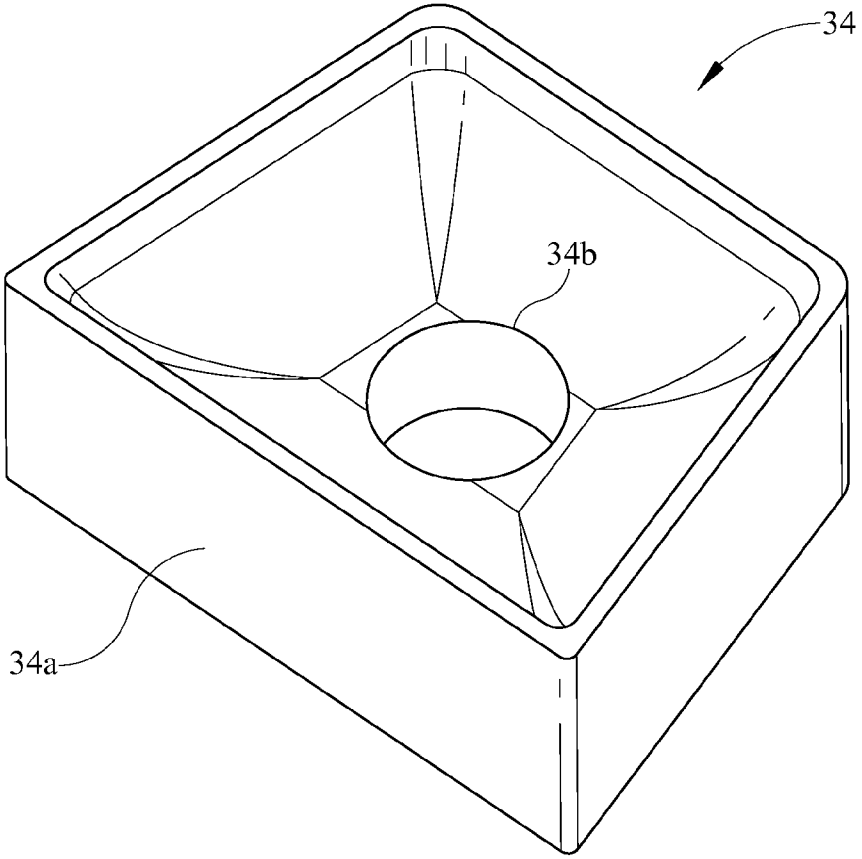
FIG. 6 depicts a perspective view of a cutting tool.

Referring now to FIG. 6, the cutting tool 34 is depicted in perspective view. The cutting tool 34 is generally trapezoidal in shape and has a curvilinear interior surface extending from the outer edge of the cutting tool 34 to an inner aperture 34*b* which receives the fasteners 39. The cutting tool 34 of the instant embodiment is merely exemplary and alternative shapes may be utilized. The lower surface 34*a* of the cutting tool 34 is generally flat and sits flush against the upwardly facing surface having aperture 31 in the toolholder 32.

Figure 7:
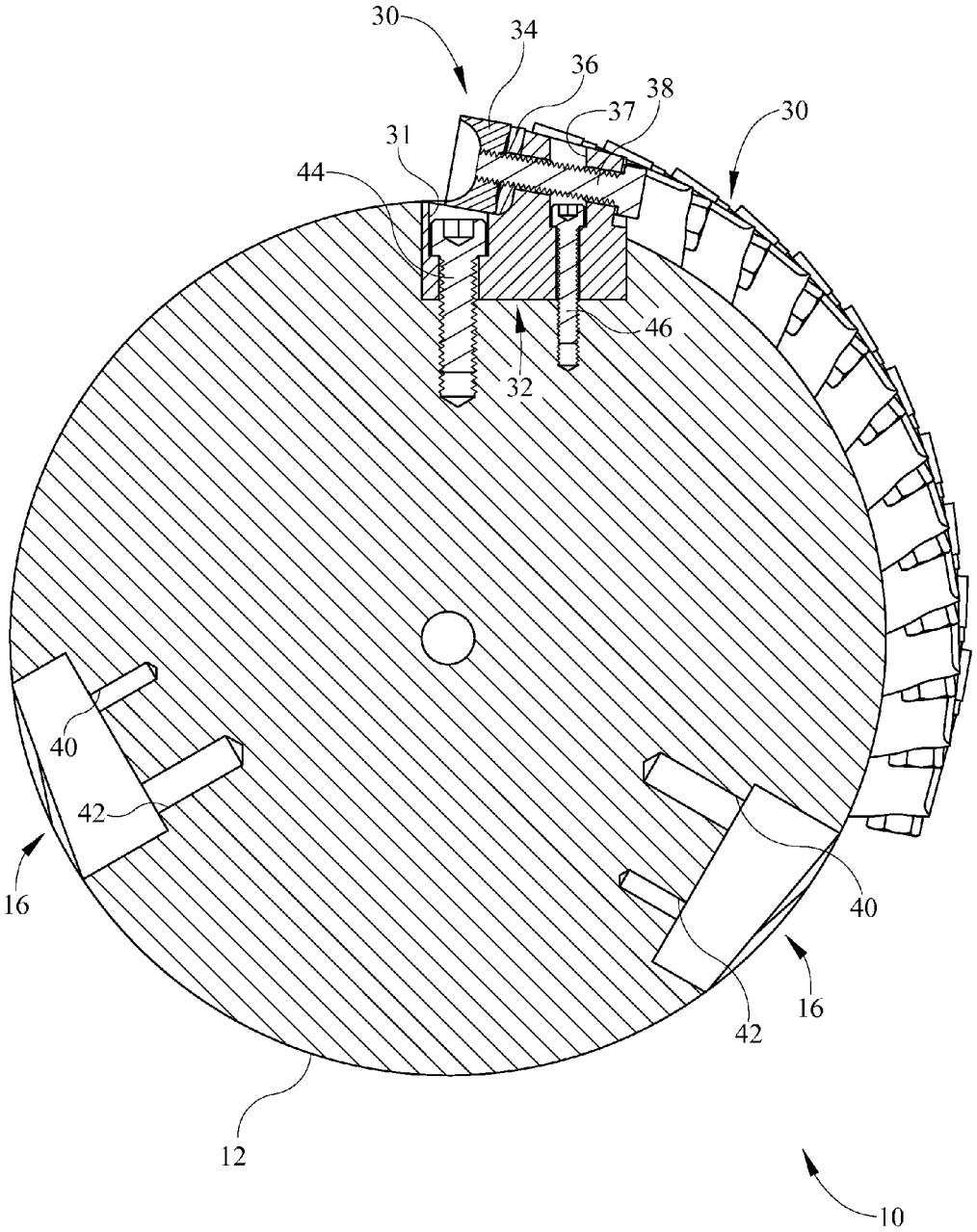
FIG. 7 depicts a side section view of the rotor assembly of FIG. 1.

Referring now to FIG. 7, a side section view of the rotor assembly 10 is depicted. Two empty pockets 16 are depicted including the first and second fastening apertures 40, 42. A third pocket 16 is shown having a toolholder 32 therein. The toolholder 32 includes the first fastener 44 extending into the rotor 12 and the second fastener 46. As previously described, the first and second fasteners 44, 46 are circumferentially aligned which allows the toolholder 32 to have a narrow width. Above the first and second fasteners and extending through the cutter mounting portion of the toolholder 32 is a third fastener 38. The third fastener 38 intersects the passage or aperture 37 for the second fastener 46. The third fastener 38 also extends through the cutter mounting portion to fasten the cutter 34 and insert 36 to the toolholder 32. The cutter 34 is positioned above the first fastener 44. Caps may be utilized to cover the fastening apertures 37, 31 in order to limit the amount of cut material which falls into those apertures.

Figure 8:
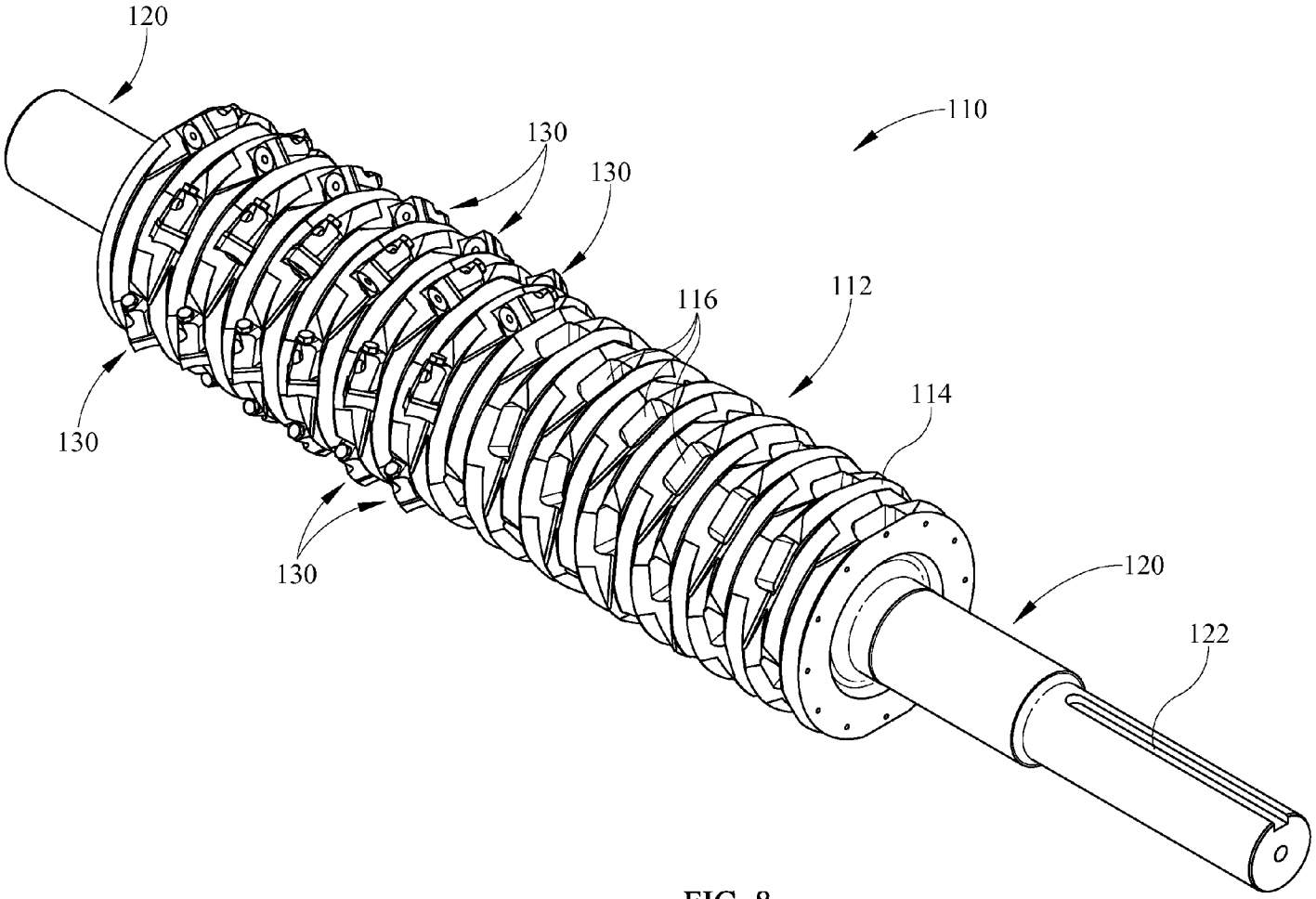
FIG. 8 depicts a perspective view of an alternative rotor assembly.

Referring now to FIG. 8, a perspective view of an alternative rotor assembly 110 is depicted. In comparison with the rotor assembly 10 of FIG. 1, the assembly 110 has a "corrugated" rotor surface 114. The corrugation may be formed by rounded crests and valleys or angled crests and valleys, as with the instant embodiment. The corrugation in welded prior art cutting tools provides a stronger bond between cutting tools and rotors than smooth surface rotors such as rotor 12. The rotor assembly 110 comprises a corrugated rotor 112 including the corrugated surface 114. Located within the corrugated portions of the rotor 112 are toolholder assemblies 130 each positioned in a pocket 116. The toolholder assemblies 130 are disposed in a preselected spacing and orientation. Each of the toolholder assemblies 130 is fastened to the rotor 112 as described further herein.

Within the corrugations 114 of the rotor 12 are pockets 116. These pockets are circumferentially offset a preselected arcuate distance from an immediately adjacent pocket 116. The pockets 116 of the present embodiment are also arranged in a chevron pattern, but spacing between toolholder assemblies of a single chevron is wider than the previous embodiment. Alternatively stated, the spacing of the toolholder assemblies 130 differs from the first embodiment in that one toolholder assembly 130 is offset a larger arcuate from a second toolholder which cuts immediately adjacent to the first assembly 130. This arrangement provides a more random presentation of cutters to the material being cut in the shredding process.

Figure 9:
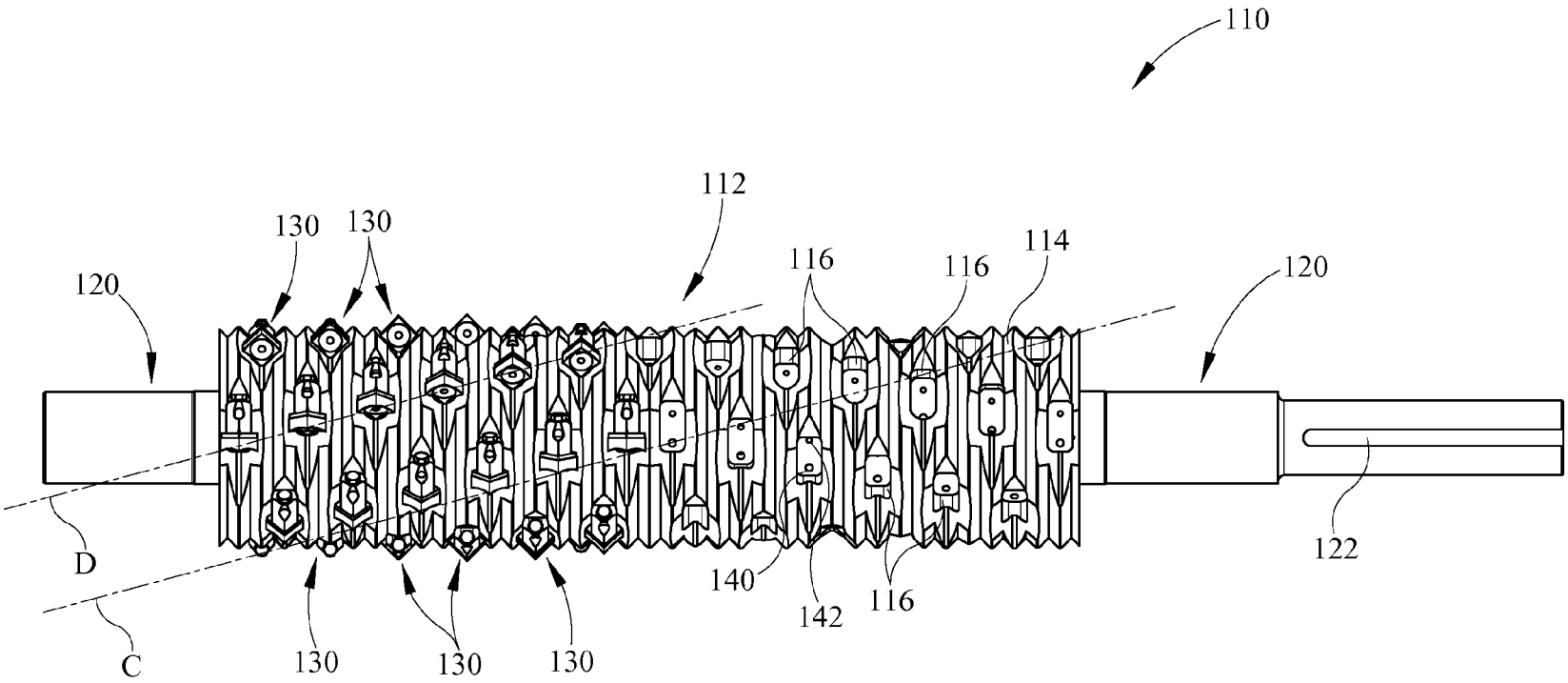
FIG. 9 depicts a front view of the rotor assembly of FIG. 8.

Referring now to FIG. 9, a front view of the rotor assembly 110 is depicted. In this view, the rotor assemblies 130 are disposed generally at an angle to the longitudinal axis of the rotor 112 and shaft 120 and defining the chevron shape. Additionally, a larger gap is seen between adjacent toolholder assemblies 130 along a diagonal cutting line. Offset an arcuate distance from the adjacent toolholder assemblies 130 of a single cutting line C are toolholders 130 of an adjacent cutting line D of toolholder assemblies which are spaced to fit within the gaps between the toolholder assemblies 130 of the first cutting line. This structure decreases the loading of the rotor assembly 110, motor and transmission.

As also shown in FIG. 9, the corrugations in surface 114 are formed by linear crests and valleys. Each of the cutting tools 134 are oriented so that a corner of a tool 134 extends downwardly into the corrugation of the rotor 112 as best seen along the upper edge of rotor 112. This allows existing corrugated rotors, which may have used welded toolholders, to be retrofit by machining pockets 116 and the bolt-in toolholder assemblies 130. As previously mentioned, the rotor 112 includes a plurality of pockets 116. Each of the pockets 116 includes a first fastening aperture 140 and a second fastening aperture 142.

Figure 10:
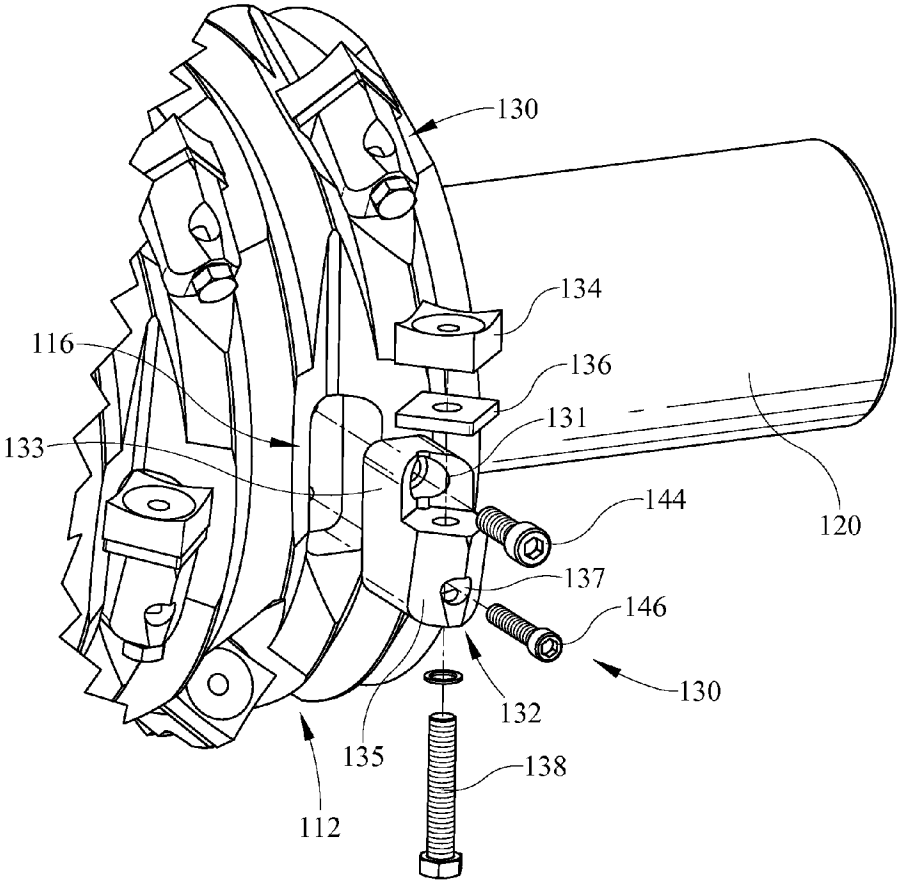
FIG. 10 depicts an exploded perspective view of the bolt-in holder.
Figure 11:
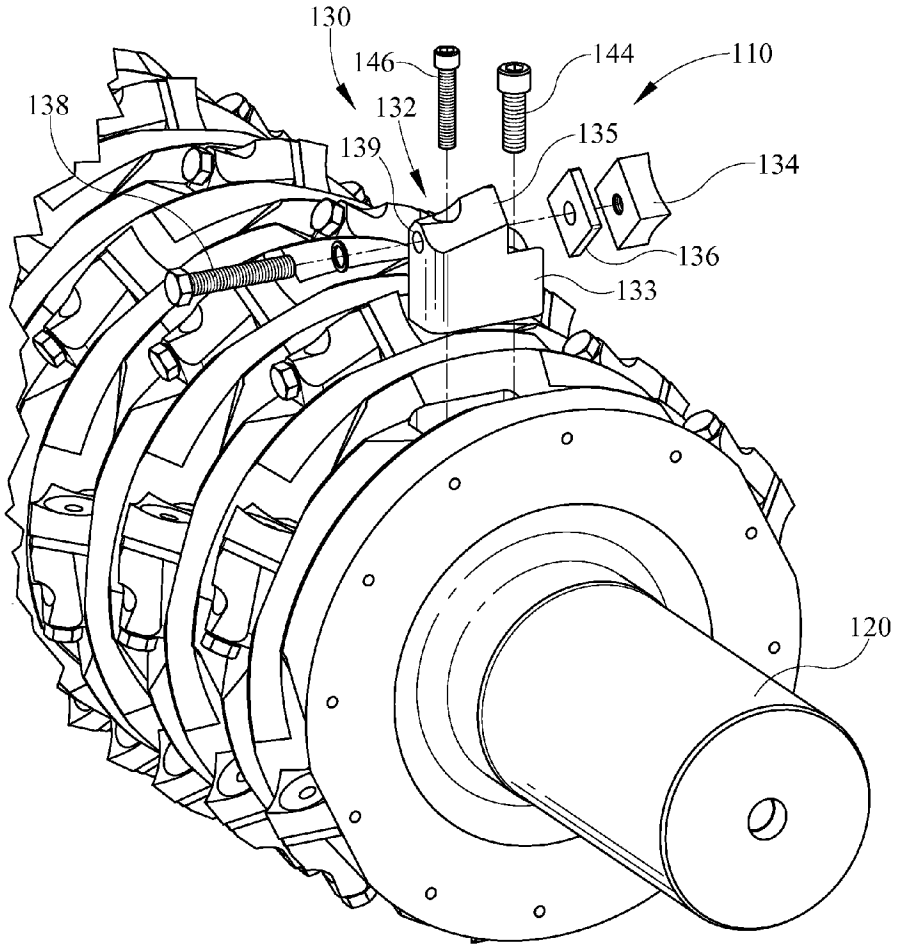
FIG. 11 depicts an alternative exploded perspective view of the bolt-in toolholder of FIG. 10.

Referring now to FIGS. 10 and 11, perspective views of a toolholder assembly 130 are depicted. The toolholder assembly 130 comprises a toolholder 132 which is sized and shaped to fit within the pocket 116. The toolholder 132 comprises a base 133 and a cutter mounting portion 135 extending from the base 133. Extending through the base 133 is a first fastening aperture 131. The aperture 131 extends radially downward toward the center of the rotor 112 and shaft 120. The surfaces through which the aperture 131 extends are not horizontal as with first embodiment but instead are angled to receive the tool 134. The cutter mounting portion 135 extends upwardly from the base 133 providing a surface against which an insert 136 and cutting tool 134 are positioned. Adjacent the first fastening aperture 135 are angled surfaces which receive two angled edges of each of the insert 136 and the cutting tool 134. It should be understood that despite the difference in numerals of the pockets 16,116, the pockets are substantially similar in size and shape so that either of the pockets 16,116 may fit either of the toolholders 32,132. In turn, one skilled in the art that the toolholder bases 33,133 are of the same size and correspond to either of the pocket 16,116. Accordingly, the pocket and toolholder arrangement may be considered universal so that pocket 16 may receive either toolholder 32,132. Similarly, pocket 116 may receive toolholder 32, 132. A user may therefore convert a rotor from a first cutting tool type, spacing, and pattern, to a second cutting tool type, spacing, and pattern depending on the type of cutting needed. Even further, the pocket and toolholder system of the instant disclosure allow for the possibility that pockets of a single rotor may receive both types of toolholders 32, 132 at the same time so as to define a hybrid cutting system.

Figure 12:
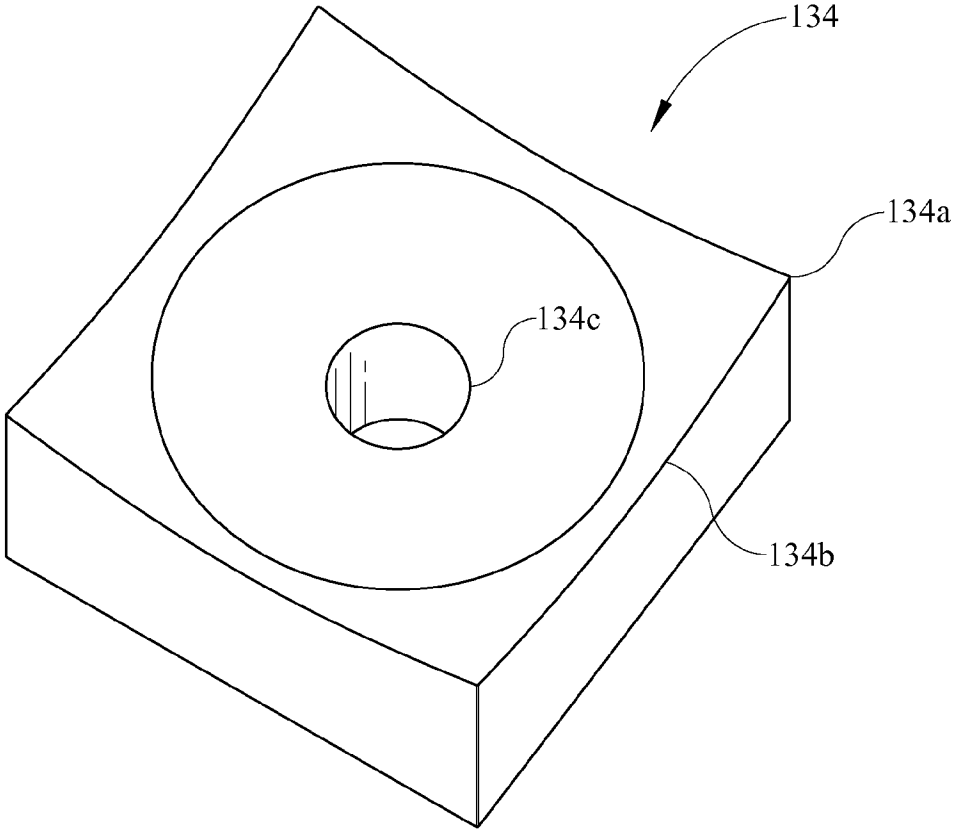
FIG. 12 depicts a perspective view of an alternative cutting tool.

As shown in the FIGS. 11 and 12 depicting the second embodiment, the cutting tool 134 is generally square in shape and is rotated forty-five (45) degrees so that one corner of the cutting tool 136 points downwardly into the base 133. The insert 136 may be formed of a polymeric or elastomeric material. Alternatively, the insert 136 may be formed of a steel or other hardened material to cushion the impact of the cutting tool with respect to the toolholder 132, and includes the radius or chamfer as previously described. The toolholder assembly 130 further comprises the first aperture 131 and a second aperture 137 extending downwardly through the cutting tool mounting portion 135. The first aperture 131 aligns with first aperture 140. The second fastening aperture 137 aligns with the second fastening aperture 142 in the rotor 112. A third fastening aperture 139 extends through the second fastening aperture 137 transversely through a mounting surface of a cutter mounting portion 135 so as to fasten the insert 136 and cutting tool 134 to the toolholder 132. As described with the first embodiment, the first and second apertures 131, 137 are circumferentially aligned allowing for a toolholder 132 which is more narrow than the cutting tool 134.

Referring now to FIG. 12, the cutting tool 134 is shown in perspective view. The cutting tool 134 is generally square in shape and has four curved forward edges. The curved edges result in the four corners being positioned slightly forward of the edges so that during the cutting process the corners 134*a* engage the material prior to the edges 134*b*. This "hawks' bill" design provides a very aggressive cut on the material being shredded and the spacing of the tools 134 are more randomized with respect to presentation to the material being shredded. The central portion of the cutting tool 134 includes an aperture for receiving a fastener. The aperture 134*c* allows fastening of the cutting tool 134 to the toolholder 132. The surface extending outward from the fastening aperture 134*c* to the edges 134*b* and corners 134*a* are concave which also aides in the cutting process.

Figure 13:
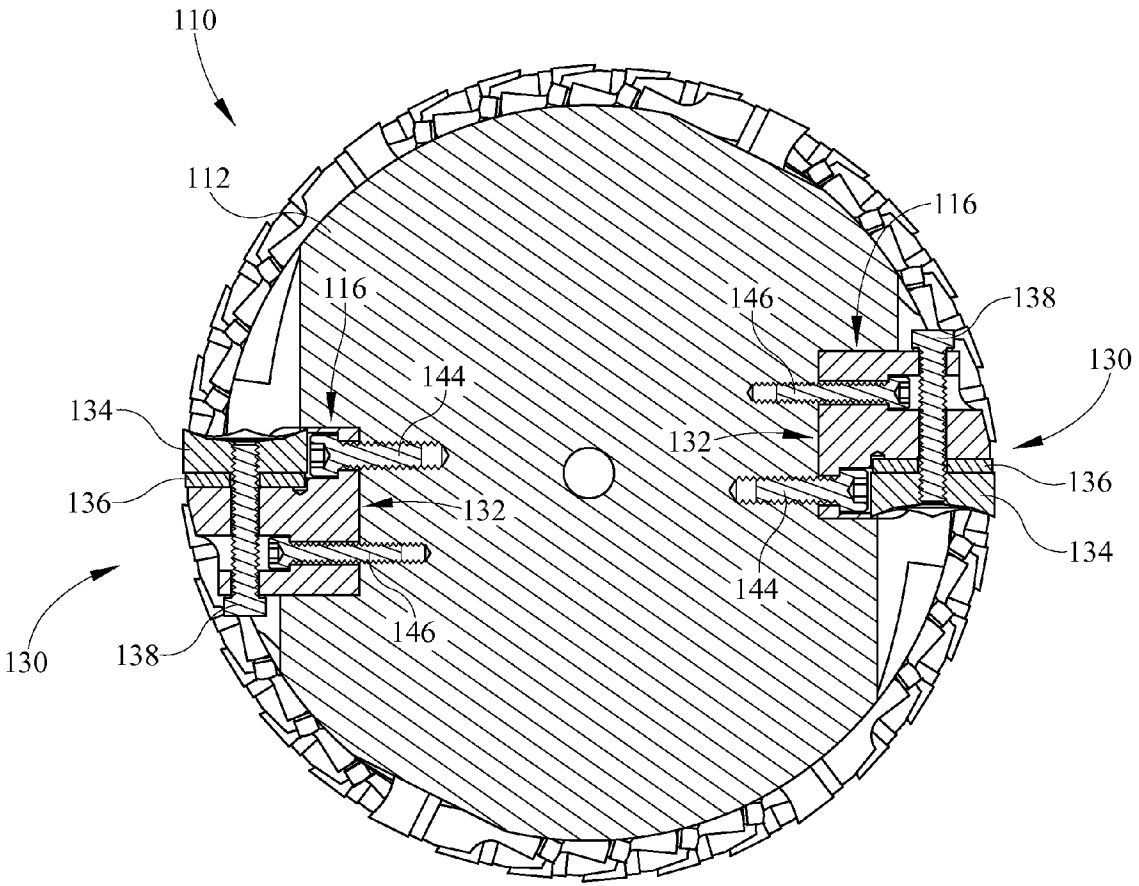
FIG. 13 depicts a side section view of the rotor assembly of FIG. 8.

Referring now to FIG. 13, a side section view of the rotor assembly 110 is depicted. The rotor 112 is sectioned depicting the toolholder assemblies 130. Each toolholder assembly includes the toolholder 132 and first and second circumferentially aligned fasteners 144 extending through the toolholders 132 and into the rotor 112. Each of the toolholders 132 is positioned in the machined pockets 116. The cutting tool 134 is shown positioned on the toolholder 132 and a third bolt 138 passes through the toolholder 132 and retains the insert 136 and cutting tool 134 thereon. The concave shape of the inner cutting tool surface, as well as the pointed corner design of the cutting tool, is also easily seen from this view.

Figure 14:
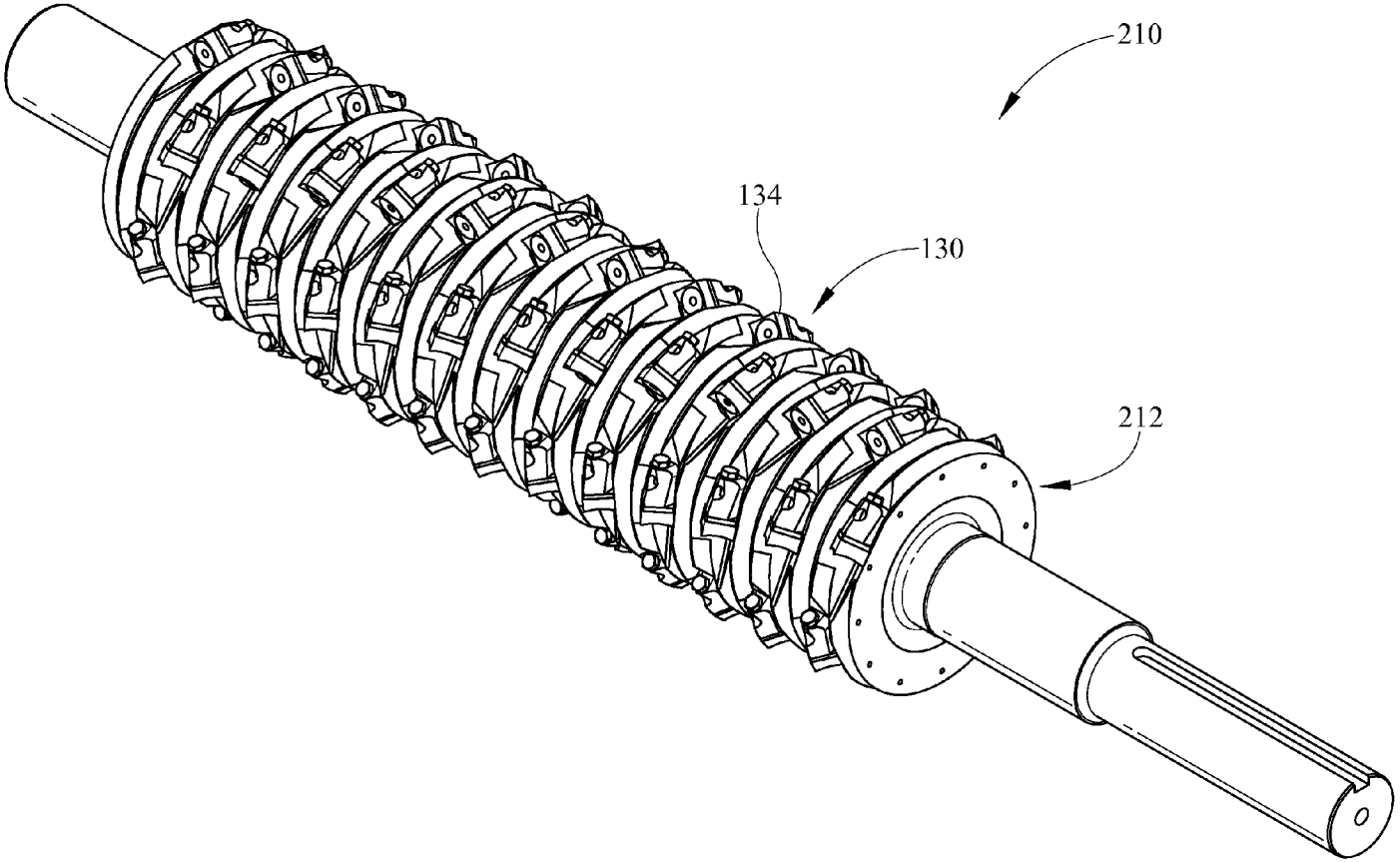
FIG. 14 depicts a perspective view of an alternative bolt-in toolholder having a spiral pattern.

Referring now to FIG. 14, an alternative rotor assembly 210 is depicted in perspective view. The rotor assembly 210 comprises a rotor 212 having a corrugated surface. The corrugated surface comprises a plurality of toolholder assemblies 130 including cutting tools 134. Each of the toolholder assemblies is arranged and disposed in a pocket. The pockets are arranged in a spiral pattern rather than the chevron pattern previously shown and described.

Figure 15:
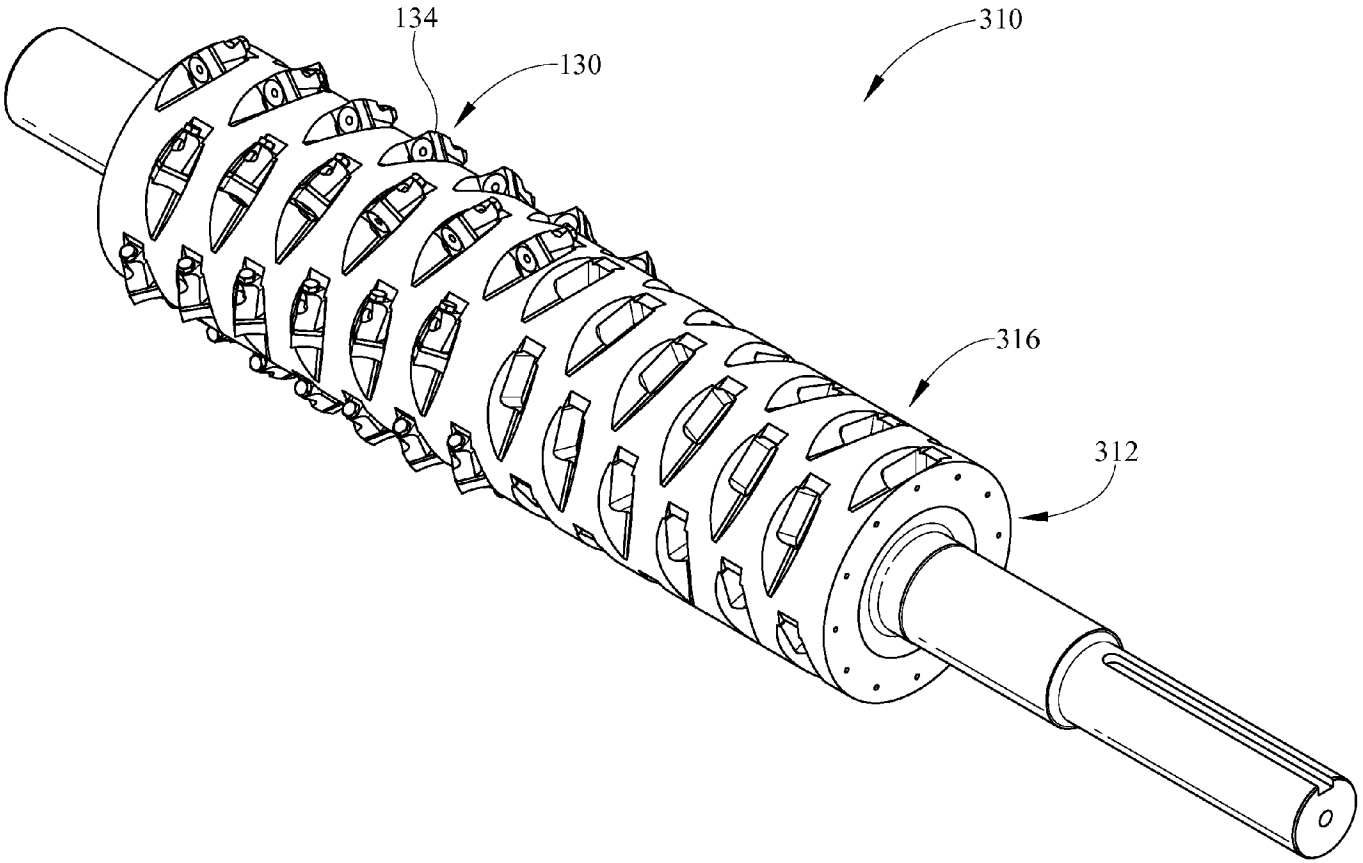
FIG. 15 depicts a smooth surface rotor having a chevron pocket pattern and the cutting tool of FIG. 12.

Referring to FIG. 15, a perspective view of an alternative rotor assembly 310 is depicted. A rotor 312 has a smooth surface and includes pockets 316. Each pocket 316 includes a toolholder assembly 130, including a cutting tool 134. The smooth surface rotor includes pockets 316 which are arranged in a chevron pattern according to the embodiment shown in FIG. 15.

Figure 16:
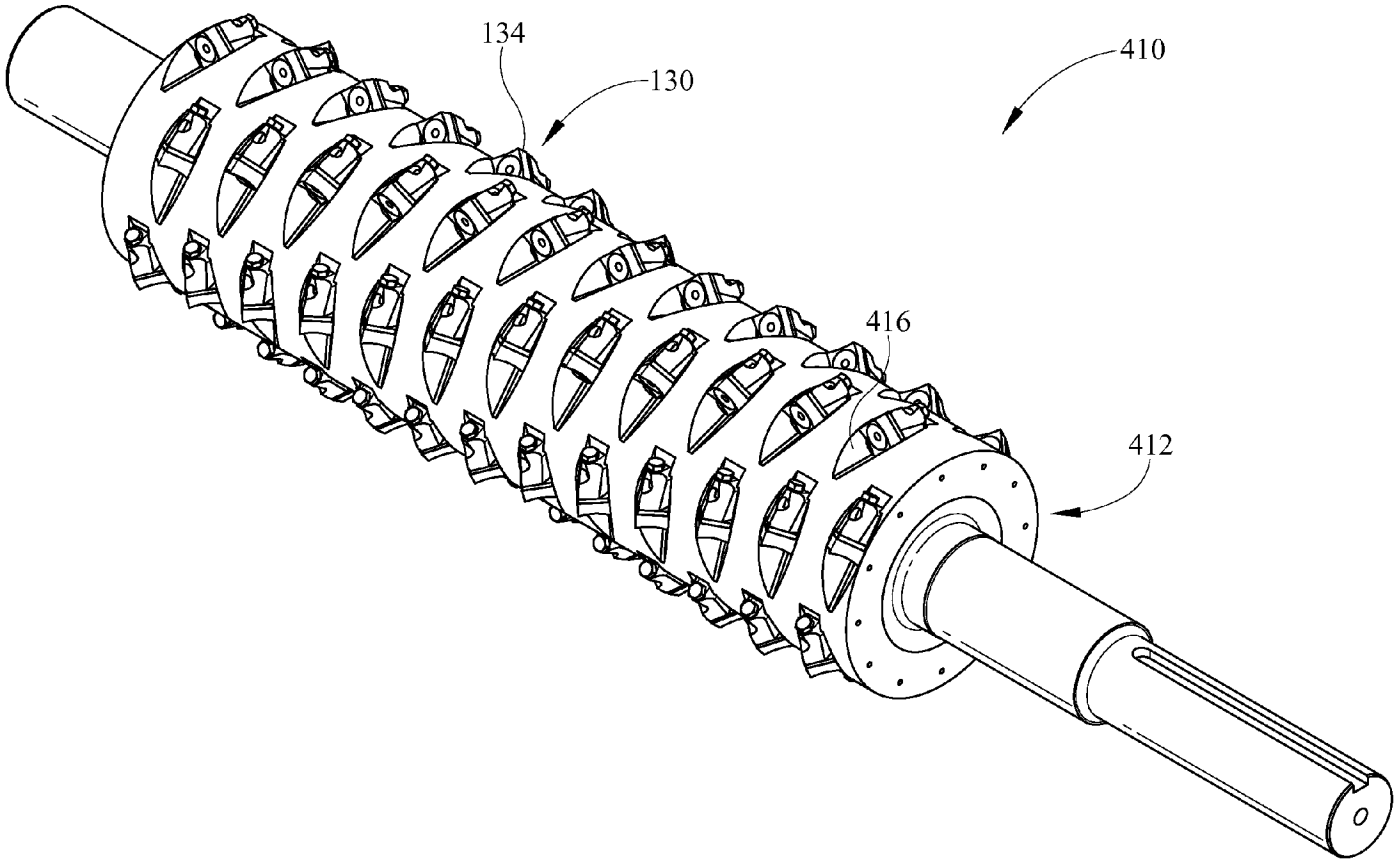
FIG. 16 depicts a smooth surface rotor having a spiral pocket pattern and which utilizes cutting tools of FIG. 12.

Referring to FIG. 16, a perspective view of an alternate rotor assembly 410 is depicted. The assembly 410 includes a rotor 412 which has a smooth surface and a plurality of pockets 416. Each pocket 416 includes a toolholder assembly 130 including cutting tool 134. Each of the pockets 416 are arranged in a spiral pattern rather than a chevron pattern.

Figure 17:
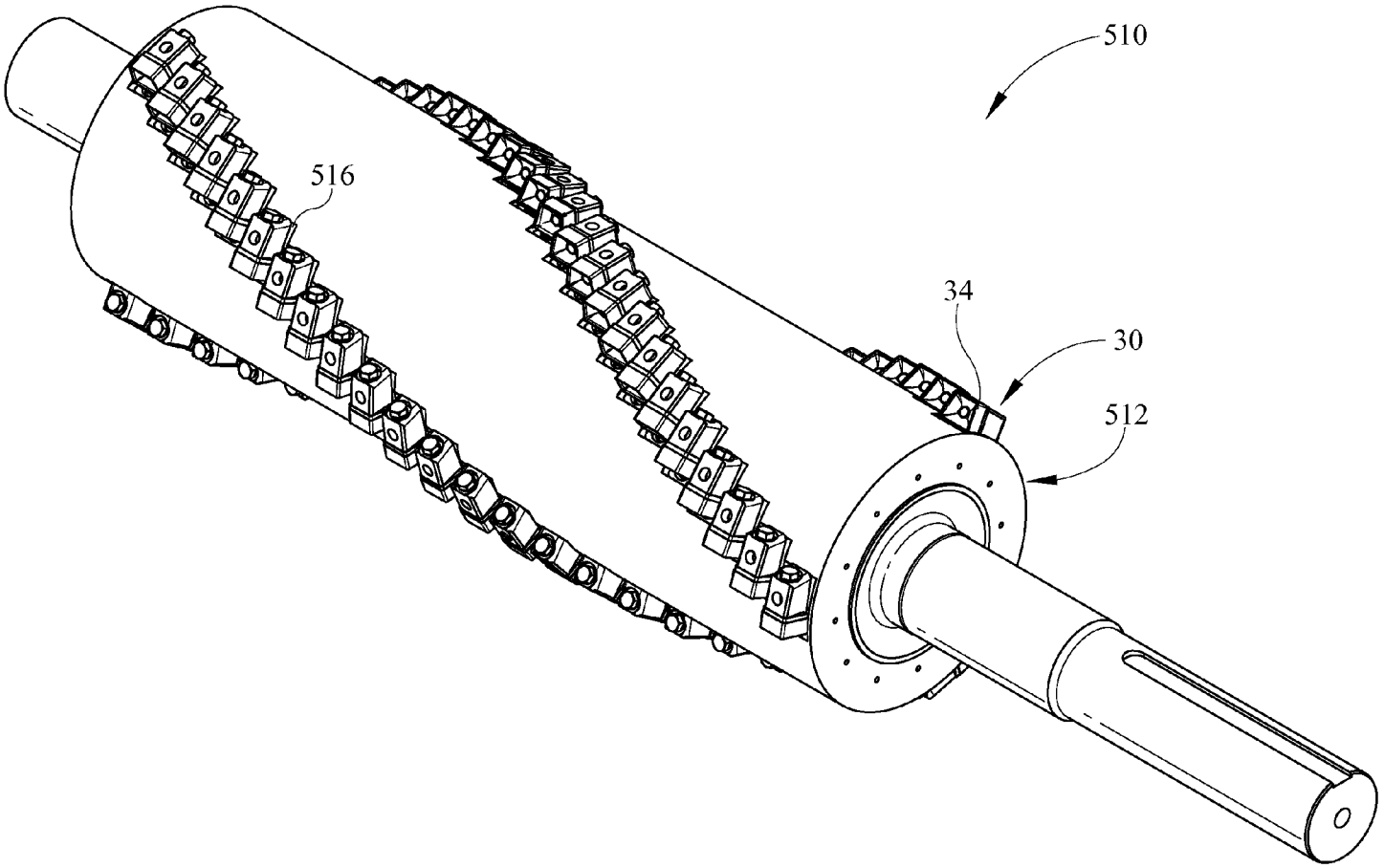
FIG. 17 depicts a smooth surface rotor having a spiral pocket pattern which utilizes cutting tools depicted in FIG. 6.

Referring to FIG. 17, an alternate rotor assembly 510 is depicted. The rotor assembly 510 includes a rotor 512 and a plurality of pockets 516 which are arranged in a spiral pattern. Each of the pockets 516 includes a toolholder assembly 30 including cutting tool 34. Thus, each of the toolholder assemblies 30, 130 may be utilized in either a chevron pattern or a spiral pattern, for example, and may be used in alternative patterns.

Figure 18:
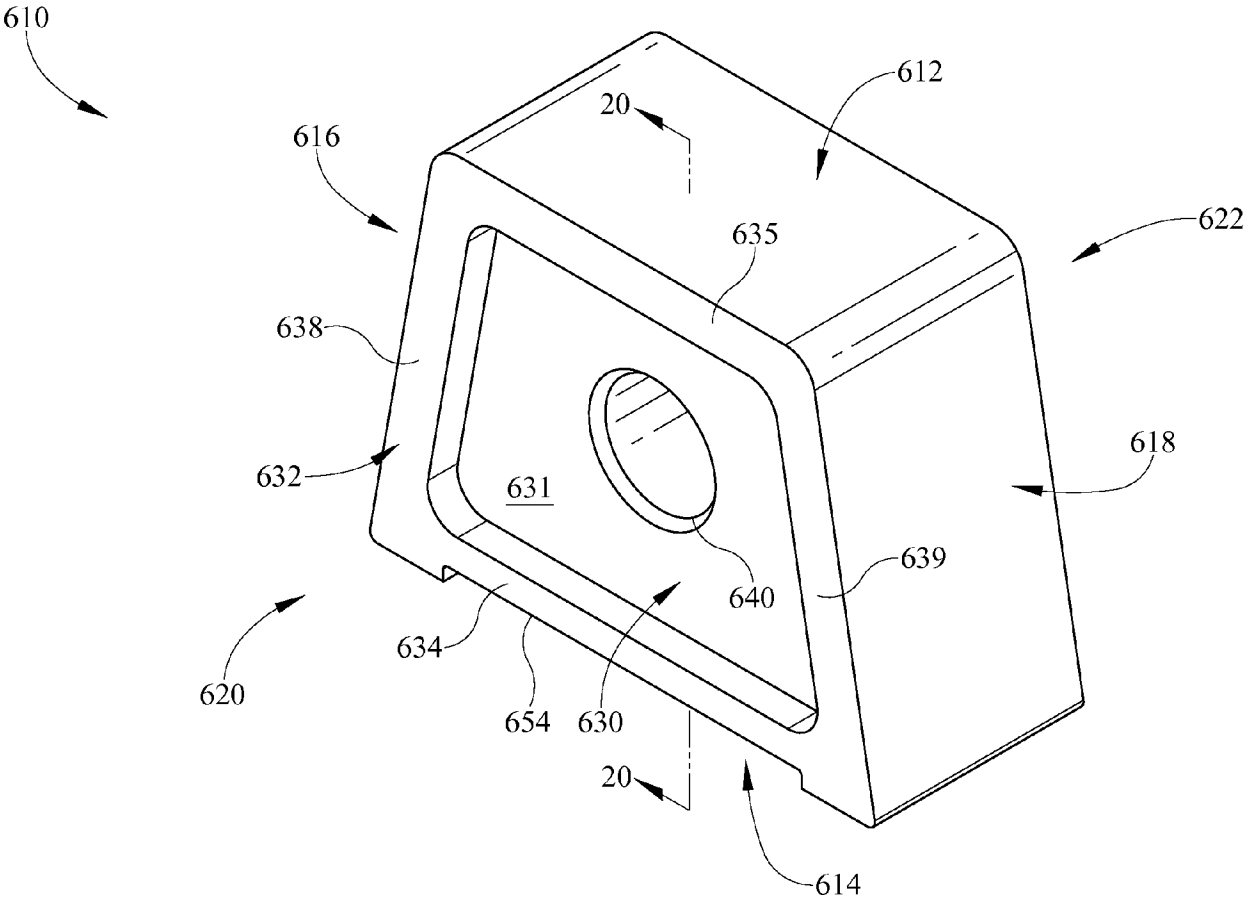
FIG. 18 is a perspective view of an alternative cutting tool.

Referring now to FIG. 18, a perspective view of an alternative cutting tool or cutter 610 is depicted. The exemplary cutter 610 is polygonal in shape and more specifically generally trapezoidal shaped. The cutter 610 forms a trapezoidal shape in two dimensions and extends in a third dimension to define a thickness of the cutter. The cutting tool 610 includes an upper surface 612, a lower surface 614 and first and second sides 616, 618 extending between the lower surface 614 (FIG. 19) and the upper surface 612. The cutting tool 610 has a front or forward portion 620 and a rear or rearward portion 622 which are reversible about a vertical axis so that the cutting tool 610 may be used to cut along both front and rear portions 620,622. The front portion 620 and the rear portion 622 include a well 630. The well 630 is defined by a perimeter cutting surface 632 and is inset from the cutting surface 632. Within the central portion of the well 630 is a bolt aperture 640. The cutting surface or land 632 has a horizontal lower surface 634, a horizontal upper surface 635 and side surfaces 638, 639 which also define the trapezoidal shape. Optionally, other polygonal shapes may be utilized for the cutting tool 610. The adjoining inside corners of these edges and surfaces are rounded for ease of machining. The cutting surface 632 has a greater width or thickness than that of the cutting tool 34 previously described. This provides several advantages. First, the wider cutting surface 632 allows for ease of grinding of rolled or worn edges (FIG. 21) back to flat or nearly flat surface in order to re-use the cutting tool, rather than replace such. Second, the wider cutting surface 632 is less prone to fracture which occurs with smaller cutting edges. Third, there is only slight or limited degradation, if at all, in performance after grinding and re-grinding of the cutting surface 632.

Figure 19:
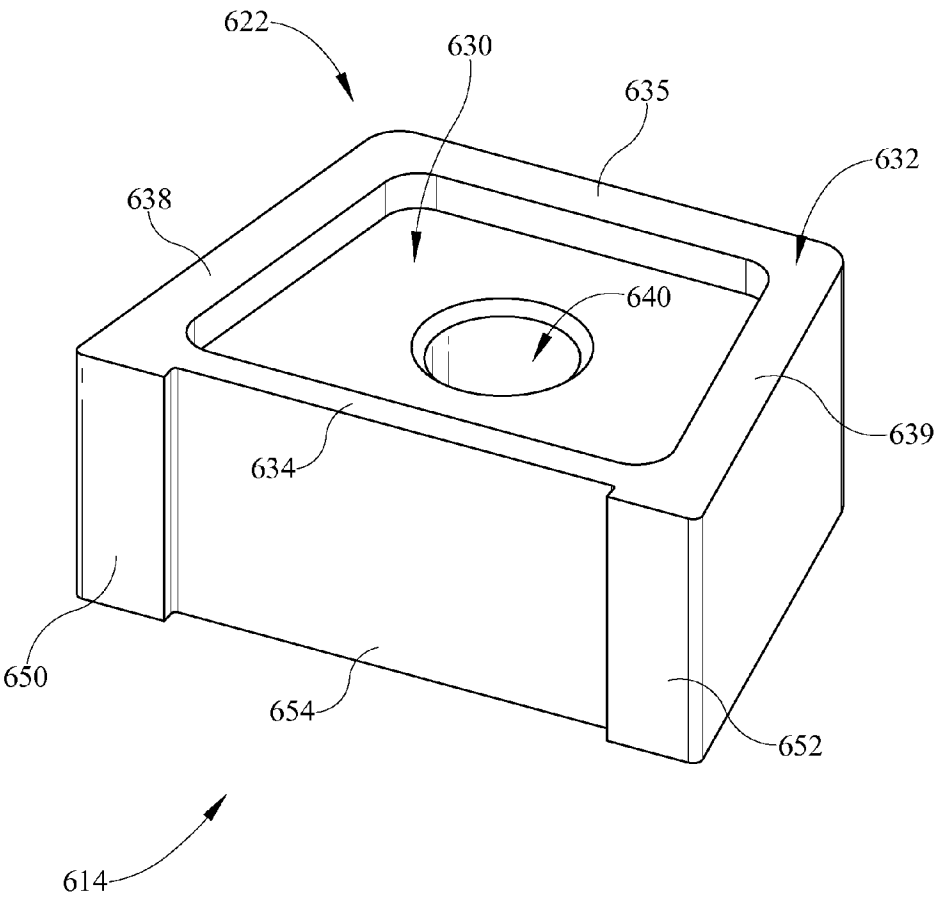
FIG. 19 is a perspective view of the lower side of the cutting tool.
Figure 22:
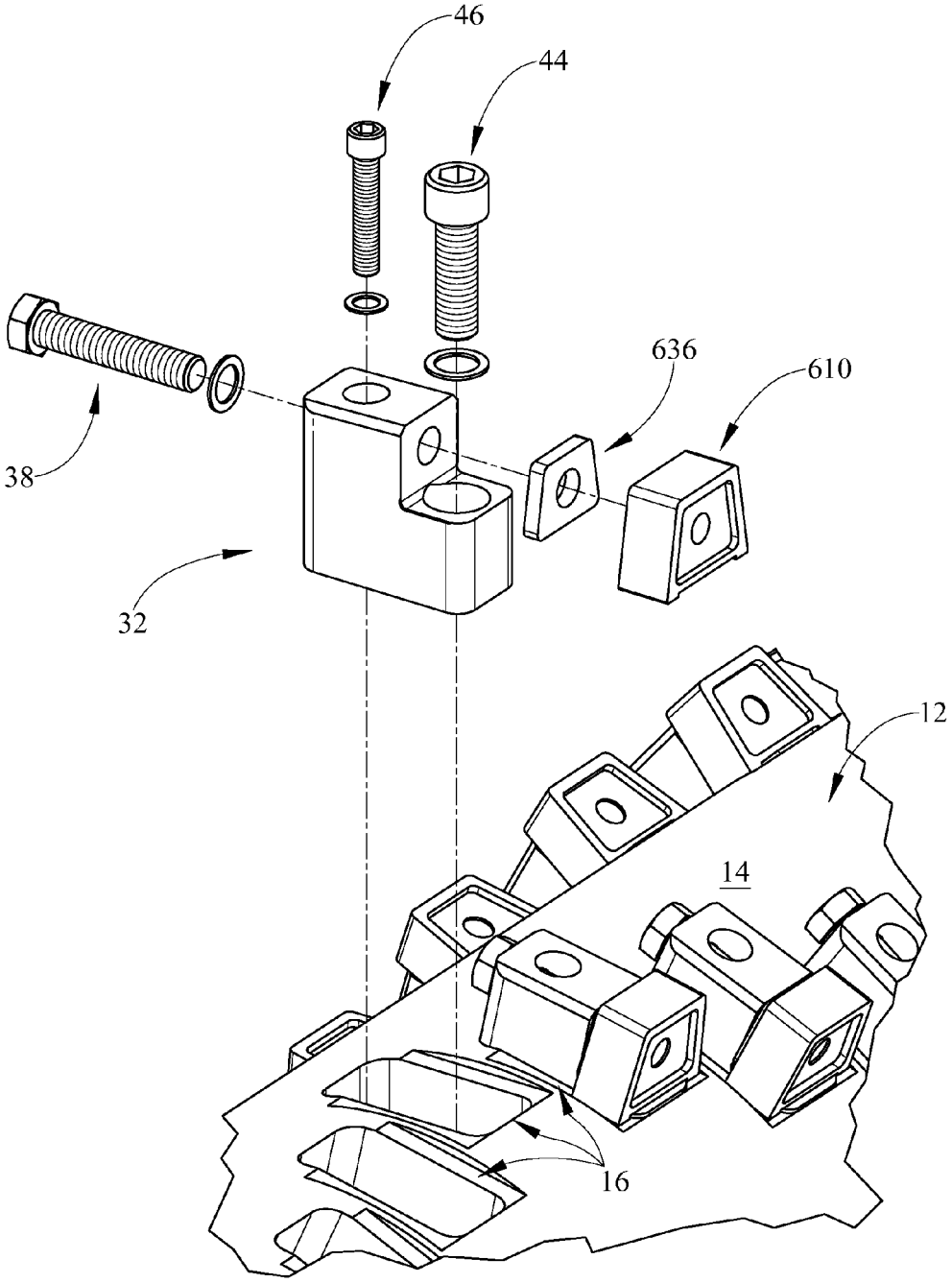
FIG. 22 is an exploded view of the toolholder and cutting tool above the rotor.

Referring now to FIG. 19, the cutting tool 610 is rotated so that the lower surface 614 and rear side 622 are depicted. The lower surface 614 has a first foot 650 and a second foot 652 between which a notch 654 is defined. The notch 654 receives a portion of the tool holder 32 so that the cutting tool 610 locates itself on the toolholder 32 (FIG. 22). Additionally, notch 654 limits thrust of the cutting tool 610 when difficult or contaminated material is cut. For example, if material is being shredded and a bolt is mistakenly left within the shredded material, impact with such bolt could shift a flat-bottom cutting tool and cause the tool to engage a counter-knife 680 (FIG. 25) on a subsequent rotation. This could cause extreme damage and machine downtime. However, the notch 654 in combination with the seating on the toolholder 32 inhibits such shifting of the cutting tool 610 relative to the toolholder 32. Additionally, the notch 654 aids indirectly with alignment of the bolt aperture 640 to the bolt aperture of the tool holder 32. The notch 654 also provides an affirmative or positive response to proper seating of the cutting tool for the installer. Similarly, and with reference to FIG. 35, an alternative lower surface of a cutting tool 610 may be utilized. For example, the tool 610 may include a key 660 depending from the lower surface 614 rather than feet 650, 652. With this key 660, a corresponding keyway 39 may be formed in the toolholder 32, or the key may be circular and fit within the aperture 31 (FIG. 4). The notch and key 660 in the exemplary embodiment are rectangular, but are not limited to such shape as other shapes and/or polygons may be utilized, that may or may not inhibit twisting of the tool relative to the toolholder 32. The key 660 also provides an indexing or positioning feature relative to the toolholder 32 insuring proper connection to the toolholder 32. In comparison to the previously described lower surface 614, the lower surface of that embodiment had feet 650,652 and a notch 654 whereas this alternate embodiment replaces the feet 650,652 and notch 654 with a key 660 and the feet are removed. Additionally, the notch 660 and feet 650, 652 may be utilized together in a single embodiment.

Figure 20:
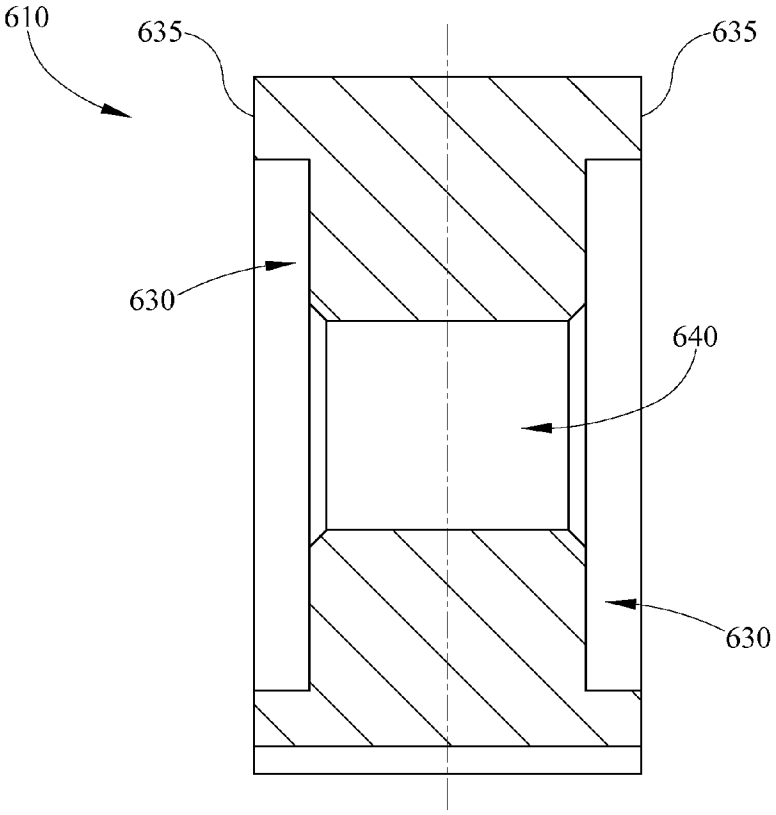
FIG. 20 is a first side-section view of the cutting tool.

Referring now to FIG. 20, a side sectional view of cutting tool 610 is shown. In this view, the front and rear of the tool 610 have wells 630. This allows the tool 610 to be rotated about a vertical axis, shown in broken line, and used to cut along front and rear surfaces. Additionally, the well 630 allows for positioning of the spacer 636 (FIG. 4) therein providing an undamaged reference surface against which the tool 610 may be seated and connected to the toolholder 32, independent of the rounded, worn or varying cutting surfaces 632, 634, 638, 639 (FIG. 19). Such structure provides reversibility of the cutting tool. Additionally, at the lower edge of surface 635, where the well 630 steps in from cutting surface 632, a biting position is defined. This corner typically bites or grabs material being cut and may slightly pull some material into the well 630. The corner also aids in holding the material as it is cut at the counterknife 680 and pulling some of the material through the counterknife resulting in a more efficient cutting of the material.

Figure 21:
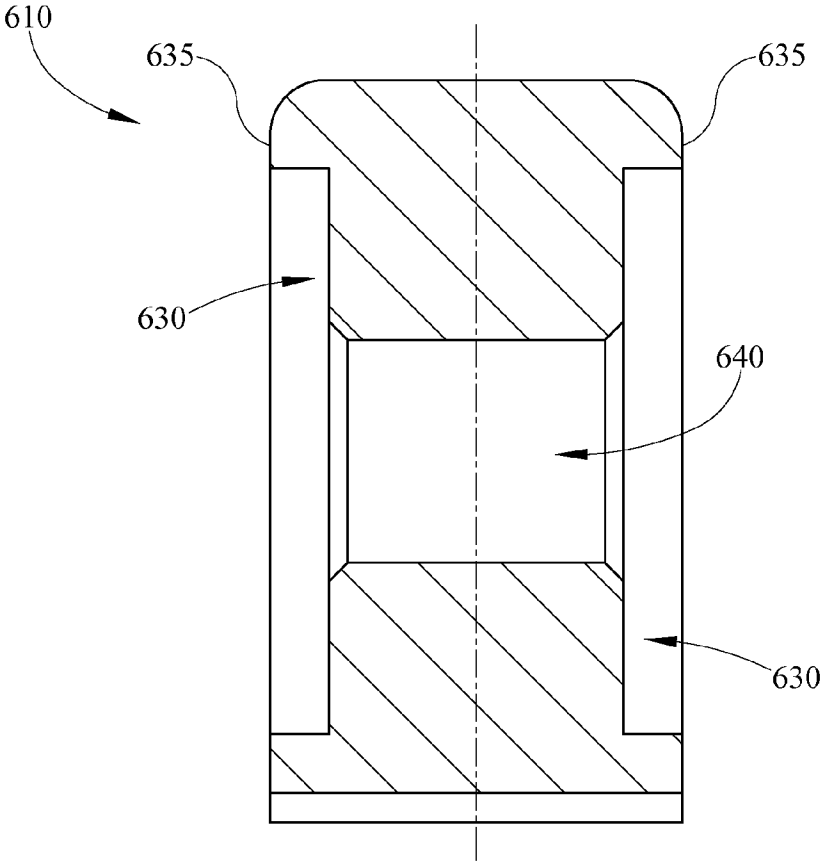
FIG. 21 is a second side-section view of the cutting tool of FIG. 20 from the opposite side and having worn cutting surfaces from use.

Referring now to FIG. 21, an alternate side section view of a worn cutting tool 610 is depicted. The upper surface 635 of the tool 610 wear during cutting use and become rounded as shown. As one side wears during the use, the tool 610 is rotated and used to cut on the opposite cutting surface. Once both cutting surfaces of the cutting tool are sufficiently worn, as shown in the figure, the surfaces 635 may be ground to flat surfaces and re-installed for use. This may occur until the well 630 is of a size no longer sufficient for proper seating of the spacer. In the instant embodiment, the cutting tool 610 is shown rotated about a vertical axis 180 degrees from the position shown in FIG. 20. In this view it is clear that in either direction, the cutting tool 610 may be used to cut material due to the symmetrical nature of the cutting tool 610 about a vertical axis. In turn this results in longer lasting cutting tools and more economical operation of the rotary grinder, as measured in dollars/pounds of material. However, as shown in FIG. 31, it is also within the scope of the instant cutting tool embodiments that a cutting tool 1610 may be embodied with a single cutting surface only. In this embodiment a well 1630 is located on one side of the cutting tool and a recess of lesser depth is located on the opposite (left-hand) side of the tool. This opposite side is not intended for cutting. In this alternate embodiment of FIG. 31, the spacer or insert is not positioned in the depression but instead extends to the periphery of the cutting tool 1610.

Referring now to FIG. 22, an exploded view of the cutting tool 610 disposed on the rotor 12 is depicted. The cutting tool 610 is exploded from the cutting toolholder 32. In such view, the configuration and orientation of the toolholder 32, an insert 636 and the cutter or cutting tool 610 are shown. In the instant embodiment, the insert 636 may be smaller dimensionally that the insert 36 in order to fit within the smaller well 630. As previously described, the well 630 is smaller than the previous embodiment so that the cutting surface 632 is larger. The bolt aperture 640 is aligned with a bolt aperture in the insert 636 as well as a bolt aperture in the toolholder 32 so as to receive the bolt 38 through the toolholder 32. As previously described, the rotor 12 includes a plurality of pockets 16 which are prearranged in a preselected spacing and configuration so as to receive the cutting tool assemblies, including the cutting tool 610, insert 636, and toolholder 32. With regard to the toolholder 32, the seating surface of the toolholder 32 may be raised slightly dimensionally in order to compensate for the raised area of the notch 654.

Additionally, as previously described, bolt 46 passes through the toolholder 32 and engages and connected to a bolt hole passing into the rotor 12. However, in removing the toolholder 32, the area receiving the toolholder in pocket 16 may become soiled with material due to the clearance required to allow seating of the toolholder 32. As a result, the material which has been cut and eliminates the clearance rendering difficult the removal of the toolholder 32. As a result, the aperture 37 (FIG. 4) may be threaded so as to receive a bolt having a shank of larger diameter than bolt 46. Such larger bolt would not fit into the corresponding aperture in the rotor 12 and therefore can act as a jack bolt to aid with removal of the toolholder 32.

The well 630 defines a seat for the insert 636. This surface 630 remains relatively constant or unchanged during grinding, as opposed to the cutting surfaces 632, so that the positioning of the cutting tool 610 relative to the toolholder 32 is unchanged over the course of use and re-surfacing of the cutting surfaces 632. Because the cutting occurs at the cutting surface 632 and not within the well 630, the inner surface of the well remains unaffected by re-use of the tool 610. Therefore, the well 630 remains a consistent positioning or indexing structure for the insert 636 despite the multiple re-surfacing processes that may occur to the cutting surface 632. The well 630 forms a seating structure in a first dimension and the notch 654, defined by feet 650, 652, forms a second seating structure in a second dimension.

Figure 23:
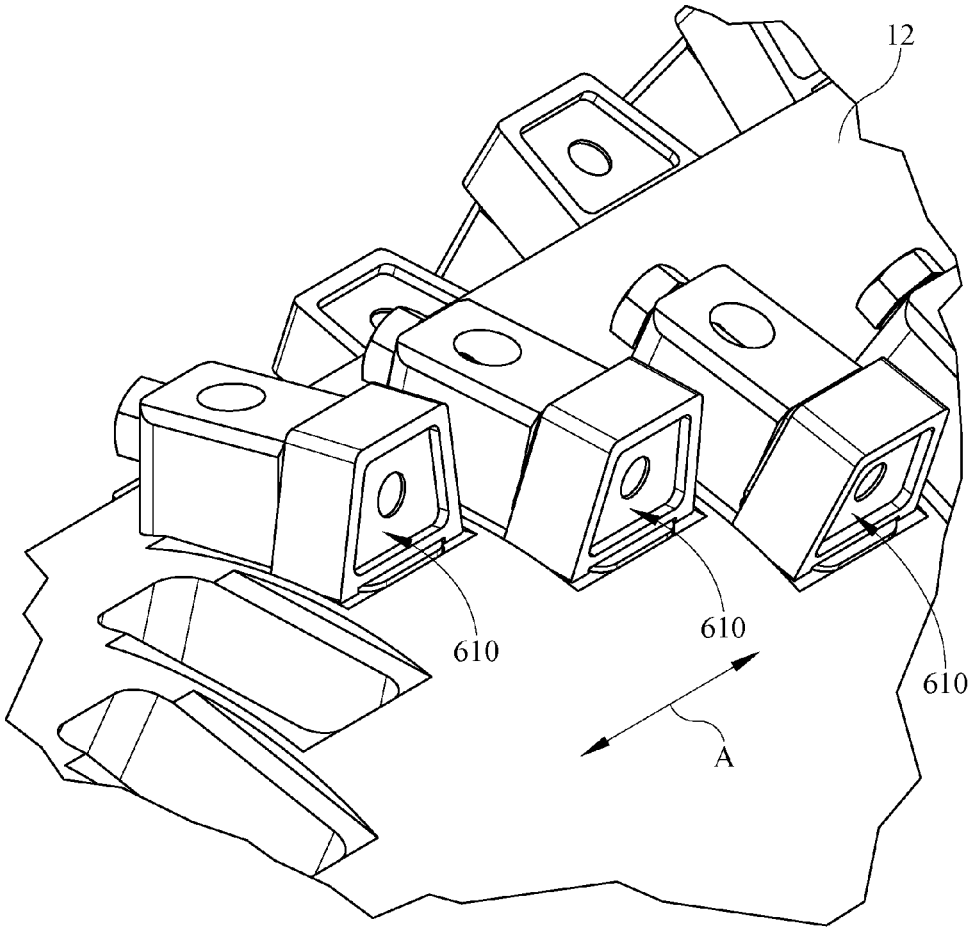
FIG. 23 is an assembled perspective view of the toolholder and the cutting tool therein.

Referring now to FIG. 23, the plurality of cutting tool assemblies are depicted assembled and disposed within the rotor 12. The cutters or cutting tools 610 are closely spaced to minimize any gap between cutters in the axial direction, indicated by arrow A, of the rotor 12. This minimal spacing in the axial direction minimizes the ability or tendency of plastics or other materials to wrap around the rotor during shredding. Such wrapping can lead to overheating and melting of the plastics as well as reducing the ability of the rotor to cut.

Figure 24:
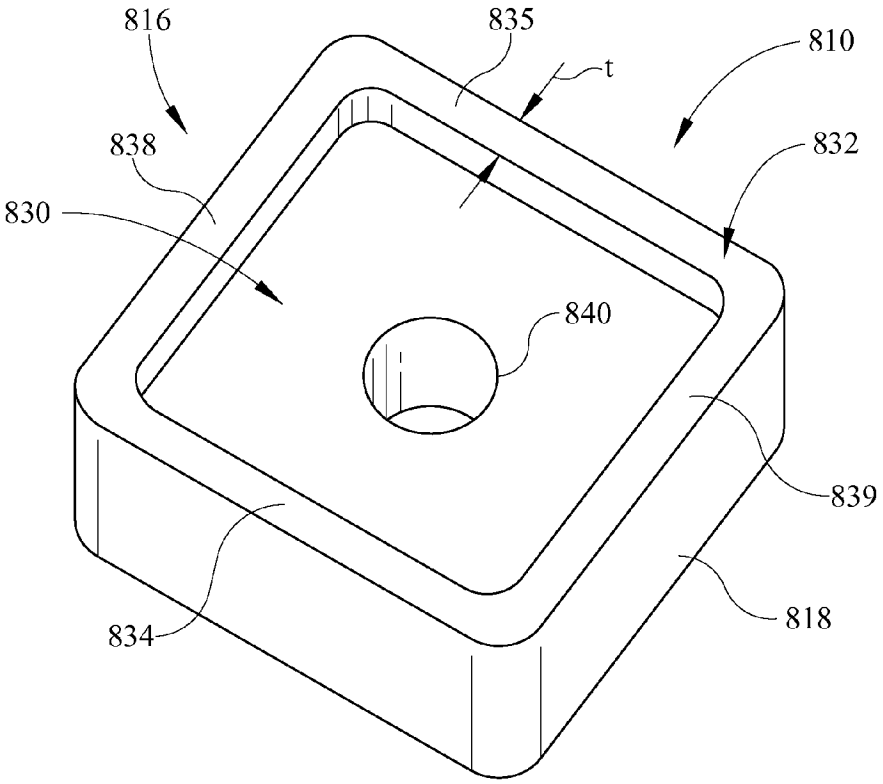
FIG. 24 is a cutting tool having an alternative square shape.

Referring now to FIG. 24, a generally square shaped cutting tool 810 with a cutting surface 832 extending about the perimeter of the tool 810. The cutting tool 810 may be used with the tool holders described herein and represents one of various polygonal alternatives that may be used for cutting material. The cutting tool 810 may be a reversible cutting tool, similar to tool 610, although such tool 810 may also be formed for cutting only along one surface. As with the previous embodiments, the cutting surface 832 has a thickness t which is thicker than prior art structures. This increased thickness allows for re-surfacing of the cutting surfaces on the depicted side and the opposite side. The tool 810 also includes an inset well 830 inside of the cutting surface 832. The well 830 may be used for positioning a spacer between the cutting tool 810 and toolholder 32. Finally, a bolt aperture 840 is centrally located in the tool 830 and is provided for connecting the cutting tool 810 and spacer to the tool holder 32, for example. Moreover, the cutting tool 810 has a cutting surface 832 comprised of upper surface 835, lower surface 834, and side surfaces 838, 839. The outer corners of the cutting tool 810 are rounded to inhibit breakage of sharp corners. And, as described previously, the cutting tool 810 is seated on a toolholder 32 and may further include feet or key, described further herein, structures to engage the toolholder 32.

Figure 25:
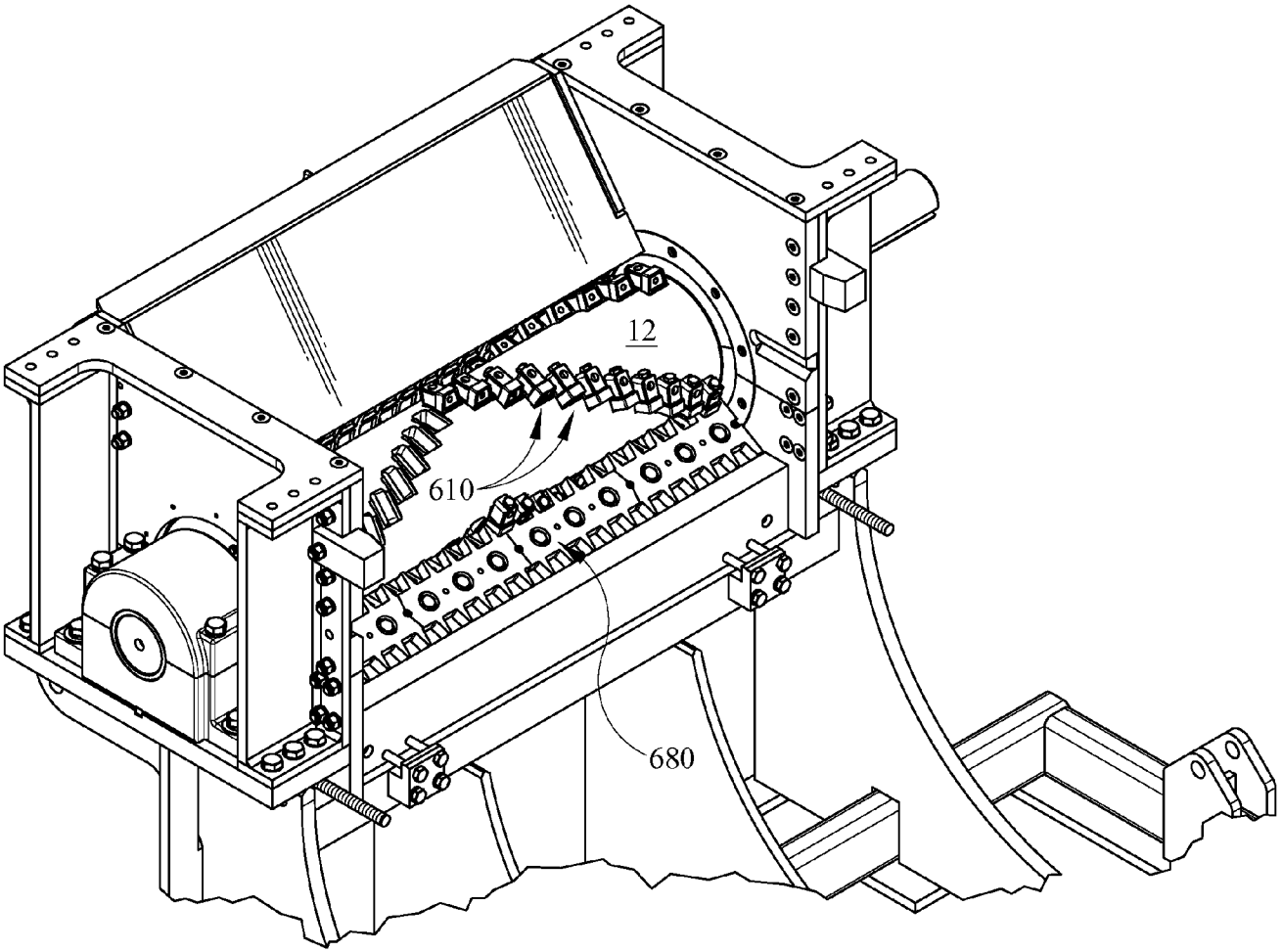
FIG. 25 is a perspective view of a portion of an exemplary rotary grinder.

Referring to FIG. 25, a perspective view of a portion of a shredding machine is shown. The rotor 12 includes a plurality of cutting tools disposed in a chevron formation with minimal spacing between each tool 610. As previously described, this minimal spacing only allows passage of the teeth or tines of counterknife 680 which extend nearly to the surface of rotor 12. Accordingly, this inhibits the wrapping of plastics about the rotor, which can eventually melt and cause other problems.

Figure 26:
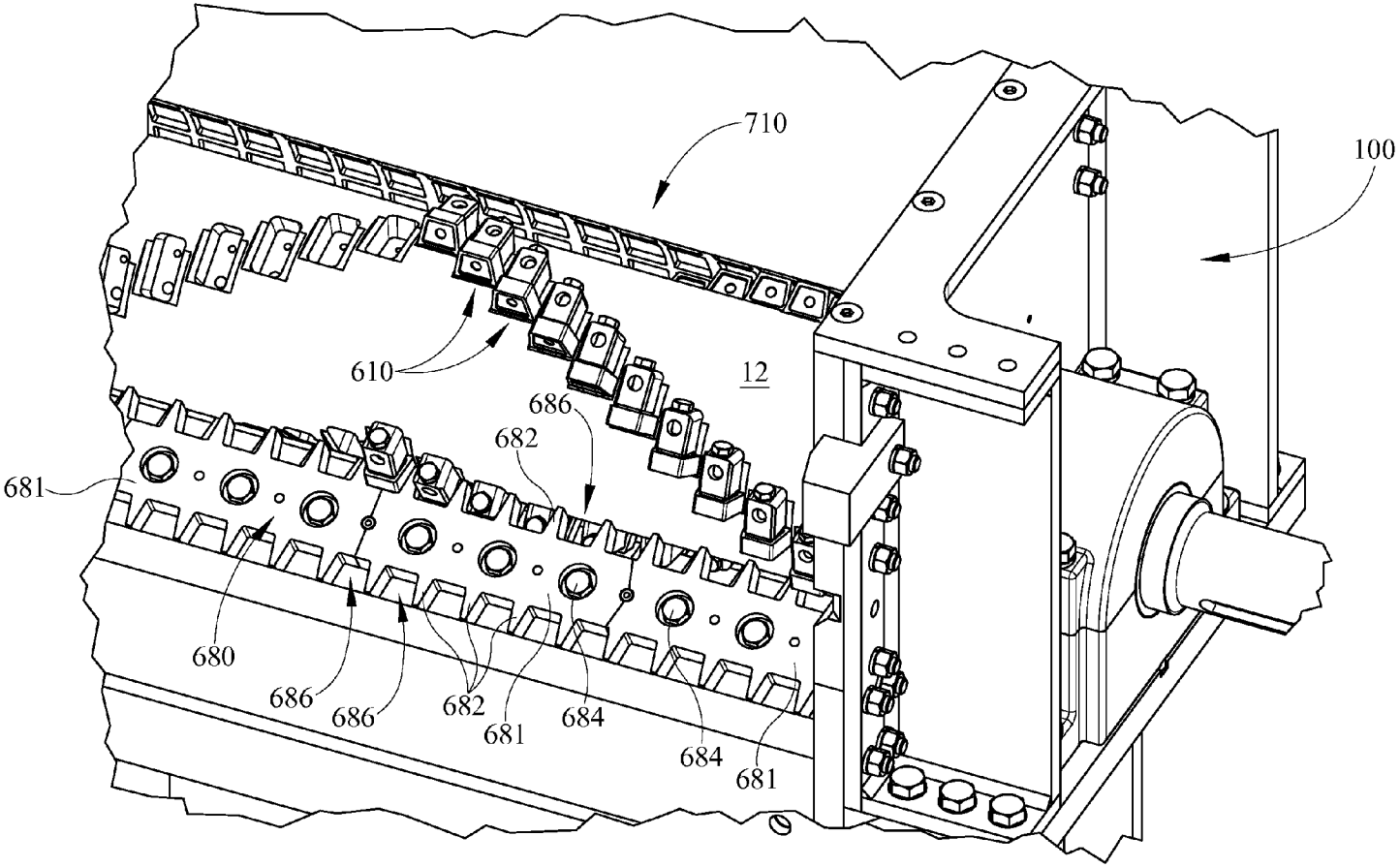
FIG. 26 is a partial perspective view the exemplary rotor and the counterknife.

Referring now to FIG. 26, a partial perspective view of internal portion of a rotary grinder or shredder 100 is depicted. The perspective view of the rotor 12 depicts a plurality of the cutting tools 610 installed on the rotor 12. Additionally, various segments 681 of counterknife 680 are shown. The segments 681 include a plurality of teeth or tines 682 which define polygon shaped passages 686, for example trapezoidally shaped according to the exemplary embodiment. The cutting tools 610 are sized to pass through the passages 686 with limited clearance. The plurality of segments 681 defining the counterknife 680 each further comprise at least one aperture 684. The at least one aperture 684 allows connection of each counterknife segments 681 to the frame of the shredding machine or grinder 100. They also provide a removability feature for each segment 681 of the counterknife 680 for replacement or maintenance of portions of or the entire structure 680. These cutting tools or cutters 610 interstitially pass through the tines 682 of the counterknife 680 in order to cut material disposed into the grinder 100.

Behind the rotor 12, a portion of a screen 710 is shown. The screen 710 includes a plurality of apertures which allow passage of cut material of less than a preselected size. As the rotor 12 rotates, the cut material of suitable size is able to pass through the apertures, after passing the counterknife 680. The screen 710 acts as a classifier only allowing passage of the material at or below the preselected sizing and retains material that is oversized for additional cutting until such material is of or less than the preselected size.

Figure 27:
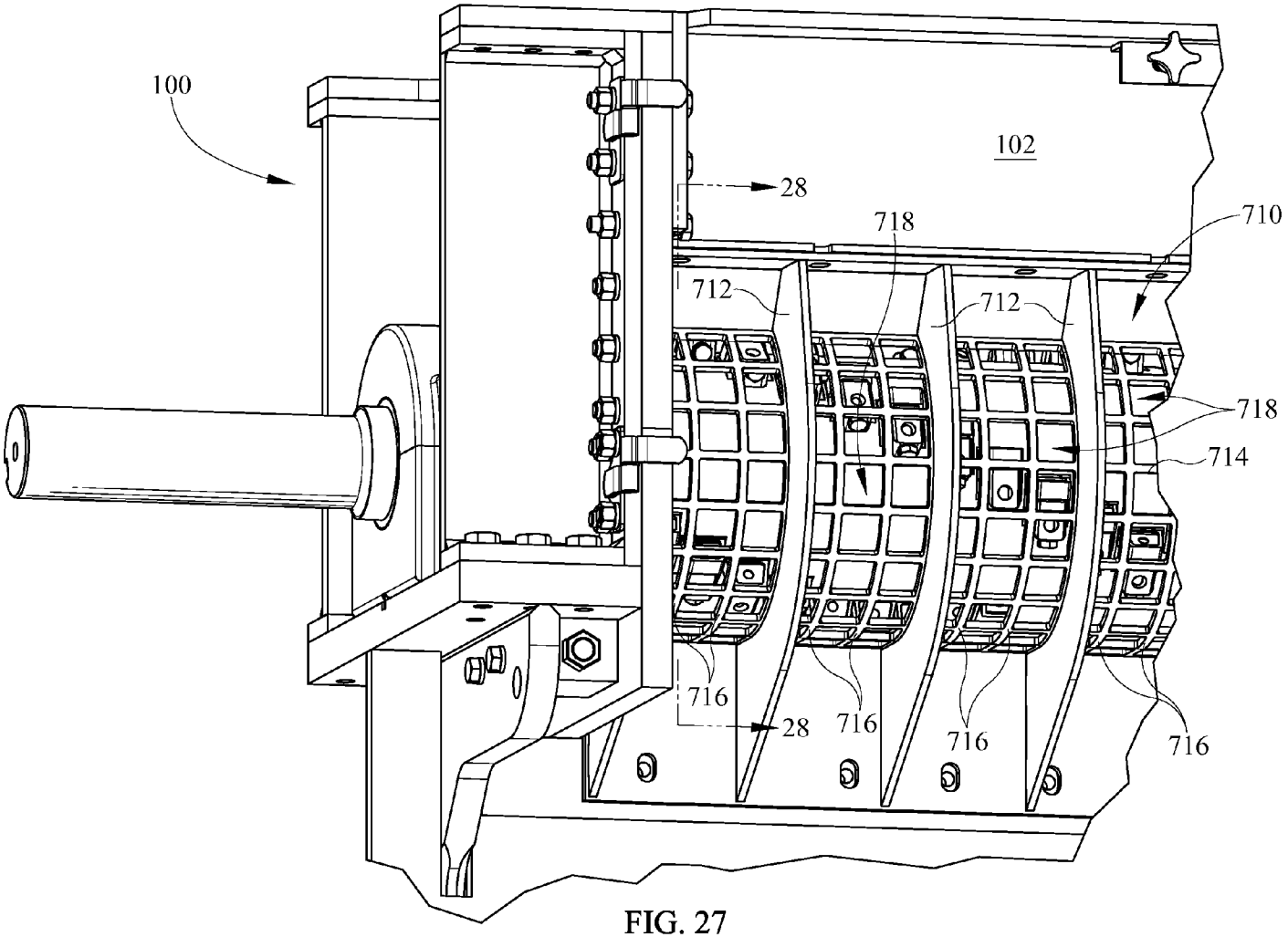
FIG. 27 is a rear perspective view of the exemplary rotary grinder.

Referring now to FIG. 27, a rear perspective view of the rotary grinder 100 is shown from the reverse side of the screen 710 shown in FIG. 25. The screen 710 is a unitary structure formed of a plurality of support ribs 712 and screening segments 714, 716. The screening segments 714 run axially and parallel to the rotor 12. The transverse segments 716 run circumferentially in the direction of rotation of the rotor 12. In an alternative embodiment, the ribs 712 may be integrally or removably connected to the rotary grinder 100 and screens 710 may be removably connected to the ribs or the rotary grinder as well to improve replaceability of the screens 710 as they wear.

The ribs 712 are connected to the segments 714, 716 and plating or other structure is utilized to connect the screen 710 to the grinder or shredder housing 102. The intersection of the screen segments 714, 716 provide a plurality of apertures 718 which are square in shape, as shown in the exemplary embodiment. However, alternate shapes may be utilized such as rectangles, alternate polygons or circles. As shown in FIGS. 32-34, three alternative aperture shapes are shown. According to FIG. 32, a U-shaped aperture 1718 is shown with a straight edge closing the U-shape. A corresponding cutting tool 610 is shown in broken line with arrows indicating a direction of motion. In this embodiment, the straight upper edge of the cutting tool, for example 610, only corresponds to the straight edge of the aperture. In a second alternative aperture shown in FIG. 33, a diamond shaped aperture 2718 is shown with the corresponding cutting tool 610 in broken line again. Similarly, a triangle-shaped aperture 3718 is shown in FIG. 34, with the cutting tool 610 moving toward the aperture as in previous figures. The triangle 3718 has a straight edge at the entrance side of the aperture, but not on the exit side as the tool moves.

Figure 28:
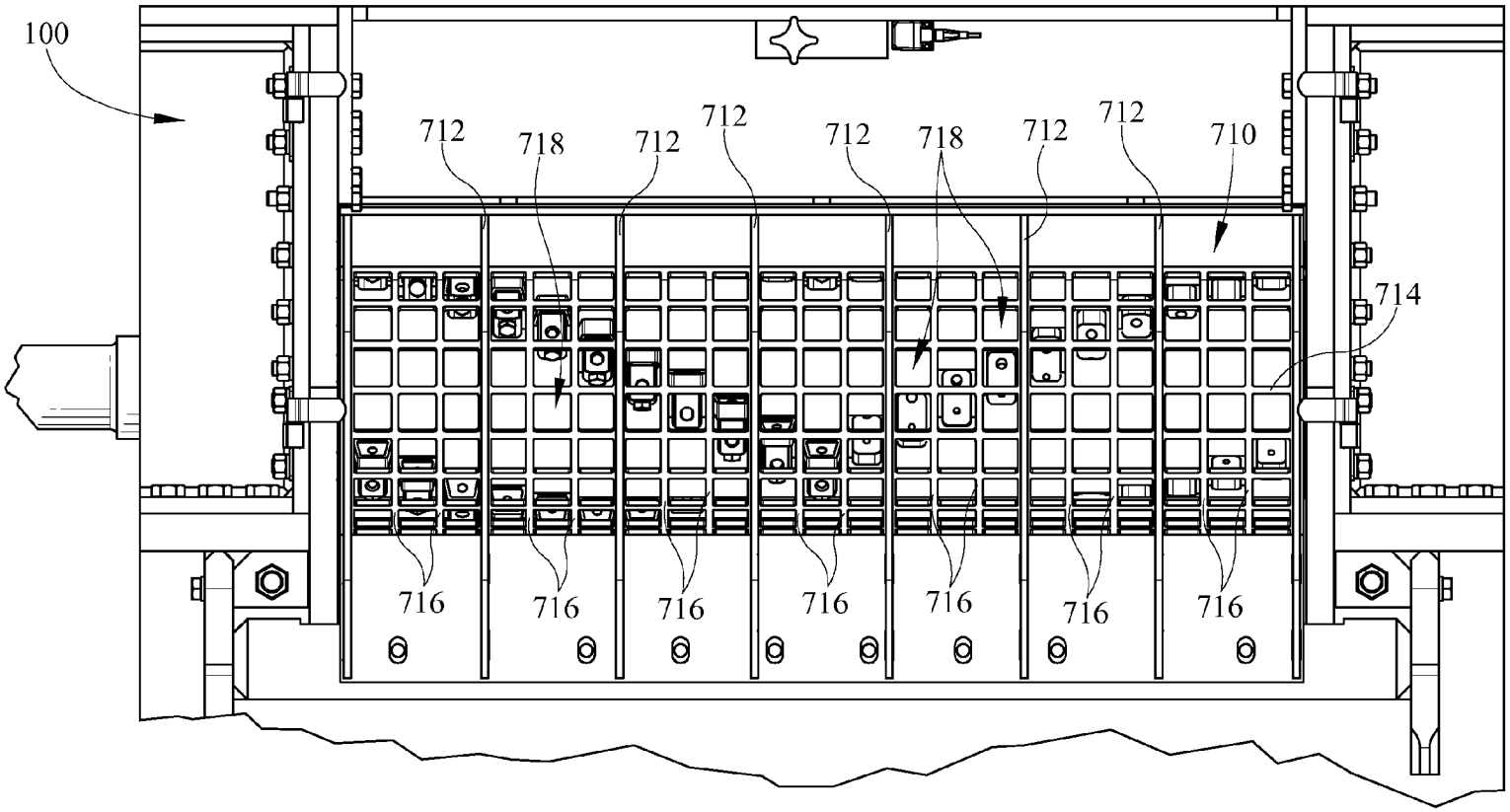
FIG. 28 is a rear view of the exemplary rotary grinder.

Referring now to FIG. 28, a rear view of the screen is depicted. As shown in the figure, the cutters 610 are aligned in an axial direction of the rotor 12 with the apertures 718. This means that the cutters 610 are generally centered with respect to the apertures 718 in an axial direction of the rotor 12. The exemplary embodiment shows a one-to-one ratio wherein each cutting tool 610 is aligned within an aperture 718 in an axial direction. However, alternate embodiments may be utilized wherein one cutting tool 610 may be aligned with multiple apertures in an axial direction or alternatively one elongate aperture is aligned with one or more cutters axially, depending on the size and shape of both structures. Additionally, this relationship will be dependent upon the type of material being cut and the output size required. In either event, the cutting tools 610 should be aligned with at least one circumferential row of apertures 718 and centered between the circumferentially extending screen segments 716. Additionally, as the rotor 12 rotates, a path is created in a circumferential direction by each cutting tool 610. The cutting tools 610 are generally centered axially with a column of circumferentially aligned apertures 718. This is made possible by the circumferentially extending segments 716 being disposed over gaps between adjacent cutting tools 610. The apertures 718 in the exemplary embodiment are aligned and/or centered in both the axial direction and the circumferential direction with the cutting tools 610. However, the apertures 718 may alternatively be misaligned in the axial direction as long as the cutting tools 610 stay centered between the circumferentially extending screen segments 716. It should be understood that there is a desirability to provide that upper straight edges of the cutting tool pass adjacent to the straight edges of the segments 714. Due to close tolerances therebetween, cutting may also occur in this area. However, the embodiments are not limited to such structure. For example, the apertures may or may not have straight edges on the exit side of the aperture which corresponding to or are positioned adjacent to the straight edges of the cutting tools.

Figure 29:
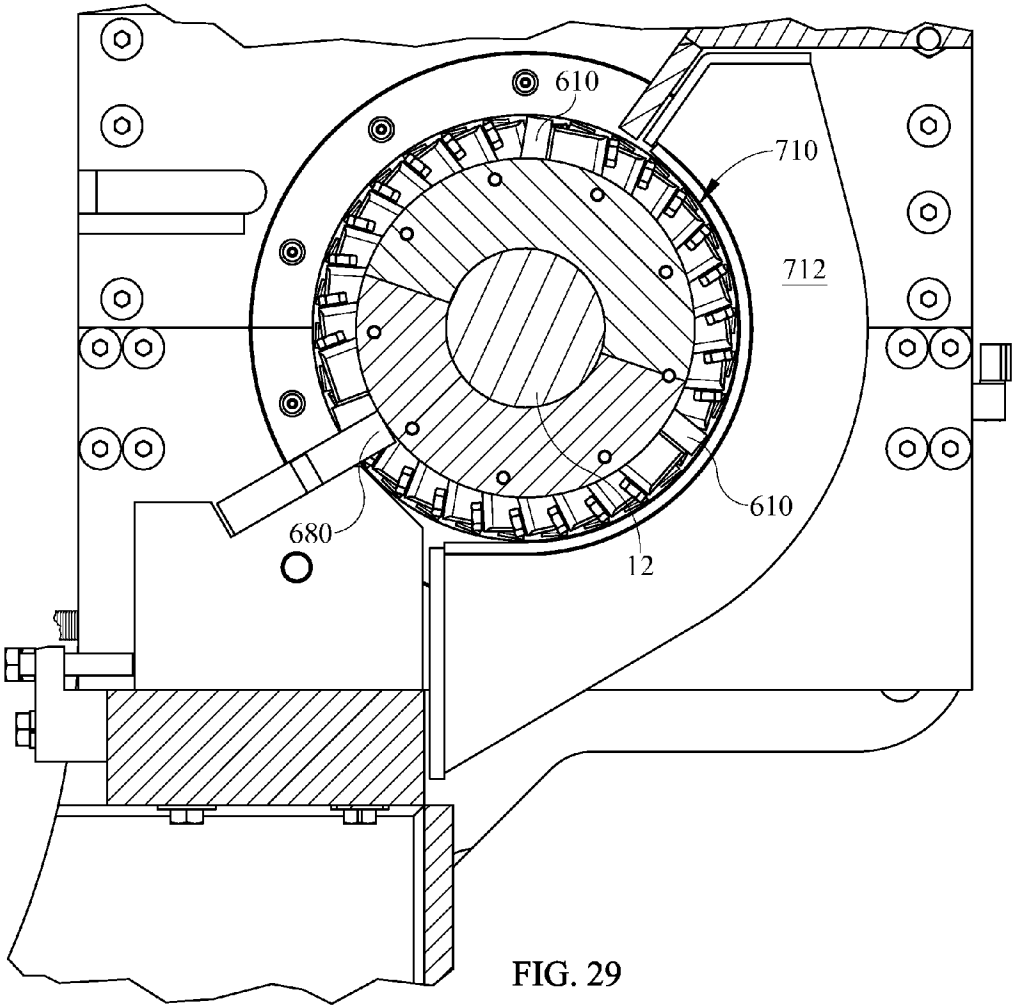
FIG. 29 is a side-sectional view of the exemplary rotary grinder.
Figure 30:
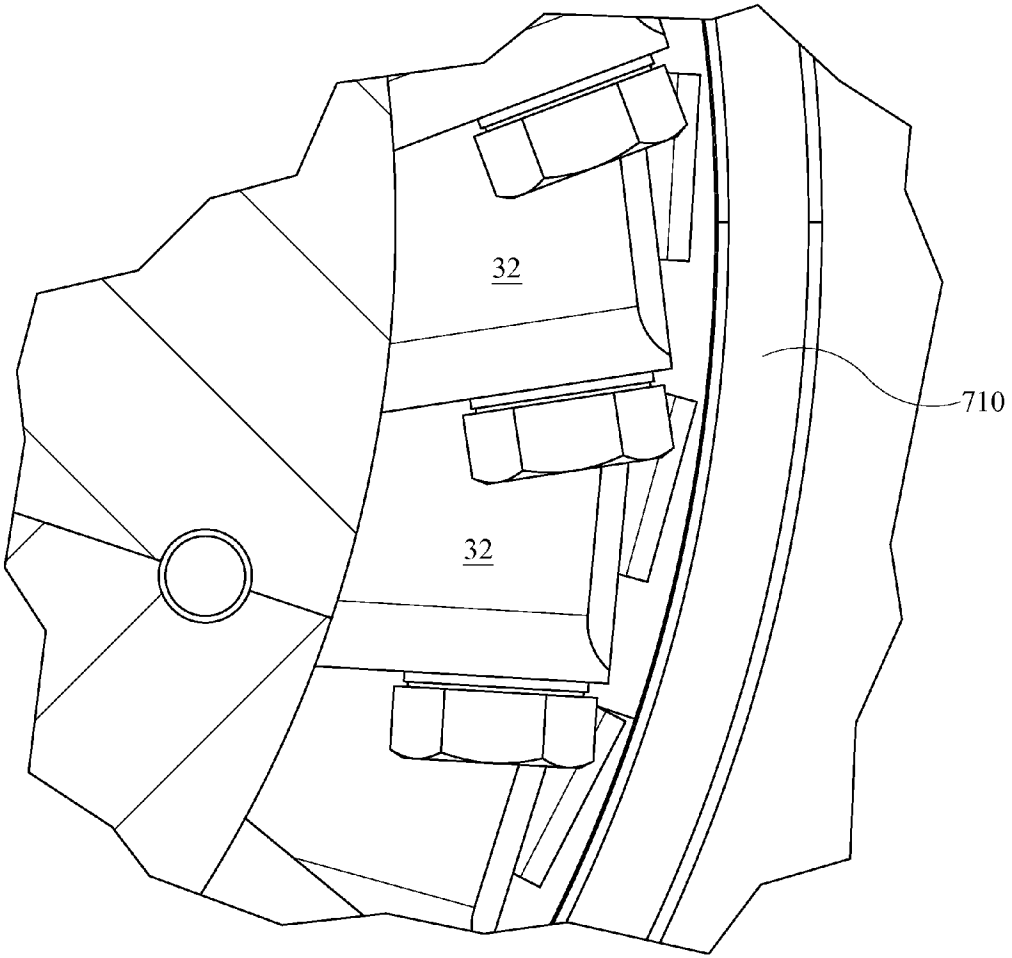
FIG. 30 is a detail section view of the toolholders and cutting tools of the instant invention.

Referring now to FIGS. 29 and 30, the cutting tools 610 are shown mounted on the rotor 12 in a side sectional view. The screen 710 is shown mounted adjacent the rotor 12 and in close proximity to the cutting tools 610. In the view of FIG. 29, and the detailed view of FIG. 30, the screen 710 is shown to have a consistent and even inner surface. This means that the inner surface of the screen 710 does not vary in height toward or away from each of the cutting tools 610 but instead is a consistent distance away from each cutting tool 610 which provides a closer tolerance and allows for cutting into finer sizes of material. When screen surfaces vary in height along the direction of rotation of the rotor, gaps between the cutter and the screen increase or decrease depending on the elevation of the inner surface of the screen causing inconsistency in cutting. This may be suitable for certain types of cutting, such as large wood and the like. However, it is not desirable for other types of materials.

Also, as shown in FIG. 29, the cutting tools 610 are disposed due to positioning on the tools 32 in such a way that the cutting surface 632 of the cutting tool leads into the counterknife 680 with the bottom edge ahead of the top edge. Alternatively, the cutting tool 610 may be adjusted by shaping of the toolholder so as to position the cutting surface of cutting tool 610 parallel to the counterknife edge or further may be arranged so that the top edge of the cutting tool leads the lower edge into the cutting knife. Thus the cutting surface 632 of the cutting tools 610 may be in a parallel or non-parallel relationship with the counterknife 680.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A screen and rotor assembly for a rotary grinding machine, comprising:

a rotor having a cylindrical shape, a plurality of toolholders disposed along said rotor, said rotor rotatable about a horizontal axis;

a screen disposed adjacent to and beneath said rotor, said screen having a plurality of apertures of preselected spacing;

a plurality of cutting tools connected to said plurality of toolholders, each of said cutting tools centered in direction of said horizontal axis with one or more of said apertures of said screens as the rotor rotates;

said screen having a substantially even surface in a circumferential and axial direction for reducing clearance between said cutting tools and said screen.

2. The screen and rotor assembly of claim 1, said screen having a plurality of screen segments defining said apertures.

3. The screen and rotor assembly of claim 2, said screen segments extending circumferentially and aligned with spaces between adjacent cutting tools.

4. The screen and rotor assembly of claim 1, said plurality of apertures being aligned in an axial direction.

5. The screen and rotor assembly of claim 4, said plurality of apertures being aligned in a circumferential direction.

6. The screen and rotor assembly of claim 1, said plurality of apertures defining a number of rows in both a circumferential direction and an axial direction.

7. The screen and rotor assembly of claim 6 wherein rotation of said rotor creates a circular path of travel for each of said cutting tools.

8. The screen and rotor assembly of claim 7 wherein said circular path of travel of each of said cutting tools is aligned with a row of said screen apertures in a circumferential direction.

9. The screen and rotor assembly of claim 1 wherein said toolholders are bolt-in toolholders.

10. The screen and rotor assembly of claim 1 wherein said apertures are rectangular.

11. The screen and rotor assembly of claim 1 wherein said apertures are substantially u-shaped with a closed end.

12. The screen and rotor assembly of claim 1 wherein said apertures are diamond shaped.

13. The screen and rotor assembly of claim 1 wherein said apertures are triangular in shape.

14. A screen and rotor assembly, comprising:

a rotor of cylindrical shape having a plurality of toolholders in a preselected spaced pattern about an outer surface of said rotor;

cutting tools connected to said plurality of toolholders;

a screen positioned adjacent to and beneath said rotor in close tolerance to said cutting tools;

said screen having a plurality of segments and each of said segments having a plurality of apertures;

said apertures forming rows in a circumferential direction about said rotor;

each of said cutting tools being centered in axial direction of said rotor relative to one or more of said apertures as said rotor rotates;

wherein a path of said cutting tools is aligned with respect to a row of said apertures extending in a circumferential direction.

15. The screen and rotor assembly of claim 14 wherein said circumferentially extending screen segments are disposed between said cutting tools of said rotor.

16. The screen and rotor assembly of claim 14 said screen being a unitary assembly connectable to a rotary grinder.

17. The screen and rotor assembly of claim 14, said screen being removably connectable to said rotary grinder.

18. The screen and rotor assembly of claim 14 further comprising a counterknife disposed adjacent to said rotor wherein said cutting tools interstitially pass through said counterknife during rotation of said rotor.

19. The screen and rotor assembly of claim 14 wherein a cutting surface of said cutting tools has a non-parallel relationship with said upper surface of said counterknife as said cutting tools enter said counterknife.

20. The screen and rotor assembly of claim 14 wherein lower ends of said cutting tools enter said counterknife before said upper ends.

21. The screen and rotor assembly of claim 14 wherein upper ends of said cutting tools enter said counterknife before said lower ends.

22. The screen and rotor assembly of claim 14 wherein a cutting surface of said cutting tools has a parallel relationship with said upper surface of said counterknife as said cutting tools enter said counterknife.

23. A screen and rotor assembly, comprising:

a cylindrical rotor having a plurality of tool holders, a plurality of cutting tools connected to said plurality of tool holders;

a classification screen positioned adjacent to and beneath a portion of the travel path of said plurality of cutting tools;

said screen having an inner surface of constant elevation;

said screen having a plurality of screen segments defining a plurality of apertures;

said plurality of apertures arranged in circumferentially extending rows wherein:

each of said plurality of cutting tools is centered in an axial direction with at least one of said plurality of apertures as said rotor rotates and, a path of travel of each of said cutting tools being aligned with one or more axially aligned apertures and adjacent said plurality of apertures of said screen.

24. The screen and rotor assembly of claim 23, said apertures being one of rectangular, triangular, diamond shaped, or substantially u-shaped.

* * * * *